US008632151B2

(12) United States Patent
Nishikawa

(10) Patent No.: US 8,632,151 B2
(45) Date of Patent: Jan. 21, 2014

(54) DRIVING DEVICE FOR LIQUID DISCHARGING HEAD, LIQUID DISCHARGING APPARATUS, AND INK JET RECORDING APPARATUS

(75) Inventor: Baku Nishikawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 53 days.

(21) Appl. No.: 13/481,677

(22) Filed: May 25, 2012

(65) Prior Publication Data

US 2012/0306954 A1 Dec. 6, 2012

(30) Foreign Application Priority Data

Jun. 3, 2011 (JP) ..... P2011-125590

(51) Int. Cl.
*B41J 29/38* (2006.01)

(52) U.S. Cl.
USPC ..... 347/11

(58) Field of Classification Search
CPC ..... B41J 2/04541; B41J 2/04543
USPC ..... 347/9–11, 20, 40
See application file for complete search history.

(56) References Cited

U.S. PATENT DOCUMENTS

| | | | | |
|---|---|---|---|---|
| 5,917,509 | A * | 6/1999 | Becerra et al. | 347/11 |
| 6,457,794 | B1 * | 10/2002 | Tajika et al. | 347/11 |
| 8,172,352 | B2 * | 5/2012 | Okada et al. | 347/11 |
| 2009/0262156 | A1 | 10/2009 | Hamazaki et al. | |

FOREIGN PATENT DOCUMENTS

| | | | |
|---|---|---|---|
| JP | 3241352 | B2 | 12/2001 |
| JP | 2006-142588 | A | 6/2006 |
| JP | 2006-188043 | A | 7/2006 |
| JP | 2009-274433 | A | 11/2009 |
| JP | 2009-286108 | A | 12/2009 |

* cited by examiner

*Primary Examiner* — An Do
(74) *Attorney, Agent, or Firm* — Studebaker & Brackett PC

(57) ABSTRACT

Present invention provide a driving device of a liquid discharging head, a liquid discharging apparatus, and an ink jet recording apparatus that are capable of realizing a desired dot shape by suppressing the generation of the meniscus without sacrificing the discharge efficiency or the landing accuracy. According to the present invention, in a case where discharging is performed a plurality of times in one recording period, and one pixel is recorded by using a plurality of droplets, by configuring the wave height change time of a rear-end side wave height change part of the final pulse of a plurality of discharge pulses to be equal to or longer than a quarter of the resonant period Tc and configuring the pulse width of the plurality of discharge pulses to be a half of the resonant period Tc.

20 Claims, 27 Drawing Sheets

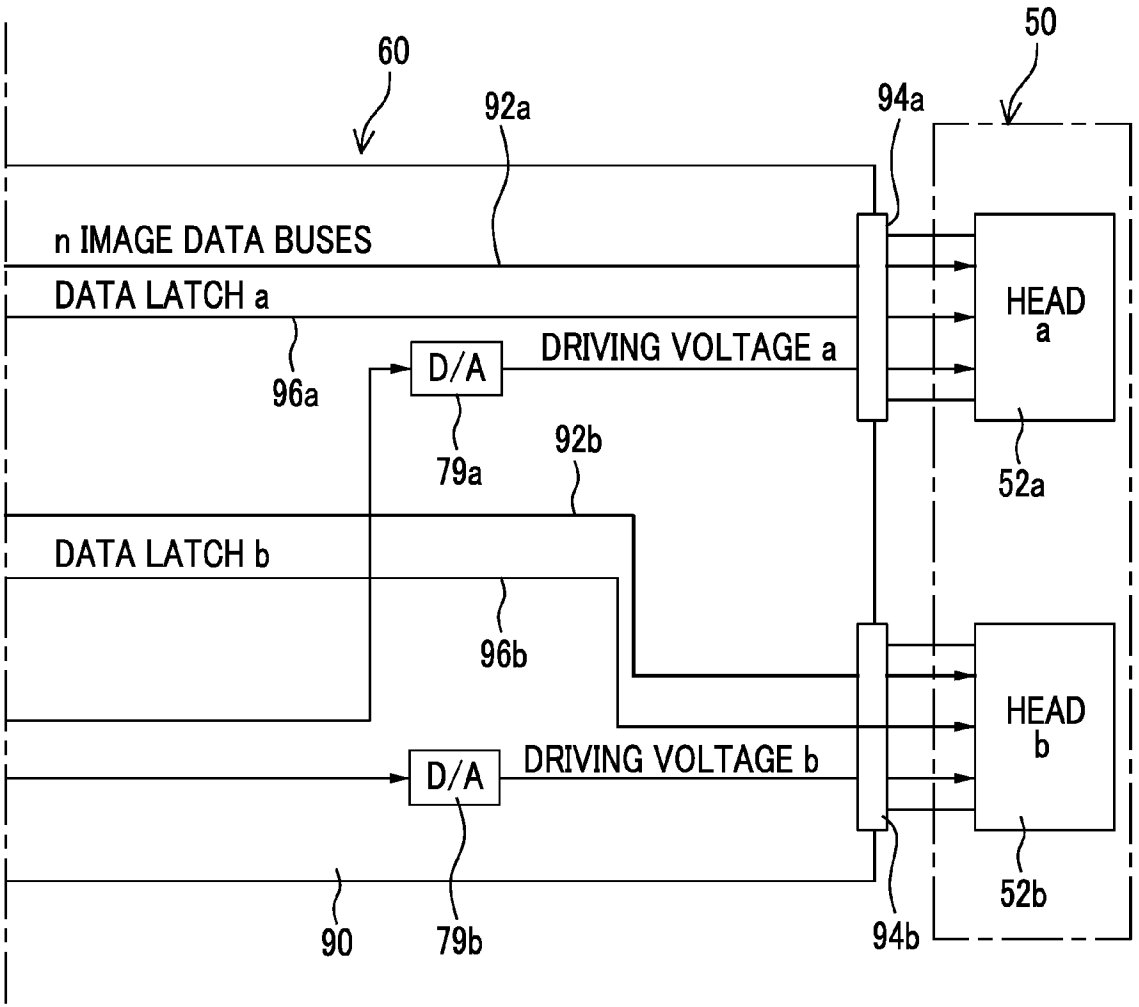
(FIG. 19 Continued)

DRIVING DEVICE FOR LIQUID DISCHARGING HEAD, LIQUID DISCHARGING APPARATUS, AND INK JET RECORDING APPARATUS

BACKGROUND OF THE INVENTION

1. Field of the Invention

The present invention relates to a driving device that supplies a driving signal used for discharging liquid droplets from a nozzle of a liquid discharging head that is represented by an ink jet head and a liquid discharging apparatus and an ink jet recording apparatus that use the driving device.

2. Description of the Related Art

In ink jet recording apparatuses, in order to form images having a high quality, the shape of each dot that configures an image is required to be a perfect circle. Accordingly, a satellite liquid droplet must be prevented from landing at a position away from a landing position of a main liquid droplet. In order to prevent the generation of the satellite liquid droplet, a method in which a resonant period (Helmholtz natural oscillation period) is used in a driving waveform or a method that is based on a combination of consecutive pulses is proposed.

In JP3241352B, an ink jet recording apparatus is disclosed in which one ink dot is formed on a recording sheet by discharging a plurality of ink droplets from one nozzle during one discharge period and integrating the plurality of ink droplets before the ink droplets arrive at the recording sheet.

In the ink jet recording apparatus disclosed in JP3241352B, pulses configuring a reference driving signal are formed as a signal such that a time interval between pulse signals configuring the reference driving signal is configured to be gradually closer to the natural period of an actuator and be gradually lengthened, so that the discharge speed of an ink droplet discharged later is higher than that of an ink droplet discharged previously.

In addition, the ink jet recording apparatus disclosed in JP3241352B is configured such that pulse signals corresponding to the number of ink discharges are selected from the final pulse signal (P5) side among a plurality of pulse signals ($P_1$ to P5) configuring the reference driving signal.

In JP2006-142588A, an image forming apparatus is disclosed which is configured so as to reduce the deterioration of the image quality due to a satellite liquid droplet by discharging a main liquid droplet in accordance with waveform elements S1 to S3, increasing the liquid droplet speed of the satellite liquid droplet accompanied with the main liquid droplet without discharging the main liquid droplet in accordance with waveform elements S4 and S5, and integrating the main liquid droplet and the satellite liquid droplet at a landing position or integrating the satellite liquid droplet with the main liquid droplet during the flight of the main liquid droplet, by using a driving waveform including a waveform element S1 that gradually decreases from a reference electric potential $V_{ref}$ to a voltage $V_a$, a waveform element S2 that maintains the voltage $V_a$ after the waveform element S1, a waveform element S3 that rises from the voltage $V_a$ to a voltage $V_b$ that is higher than the reference electric potential $V_{ref}$ after the waveform element S2, a waveform element S4 that maintains the voltage $V_b$ between a maintaining time $T_w$ in a range from Tc×(1/2) to Tc×(3/2) for a natural frequency Tc of a liquid chamber after the waveform element S3, and a waveform element S5 that gradually decreases from the voltage $V_b$ to the reference electric potential $V_{ref}$ after the waveform element S4.

In JP2006-188043A, it is disclosed that, by including an expansion pulse used for expanding a pressure generating chamber, a first contraction pulse used for contracting the pressure generating chamber after the expansion pulse, and a second contraction pulse used for contracting the pressure generating chamber after the first contraction pulse and setting the pulse width of the expansion pulse to 0.7 AL to 1.3 AL (here, AL is a half of the acoustic resonant period of the pressure generating chamber) and setting the pulse width of the first contraction pulse to 0.3 AL to 1.5 AL, positive pressure waves according to the contraction can be added together so as to increase the discharge pressure (discharge speed) of the liquid droplet when a negative pressure wave due to the expansion of the pressure generating chamber at the time of starting to apply the expansion pulse is inverted to be a positive pressure wave in 1 AL, and accordingly a discharge force having the highest efficiency is acquired.

In addition, in JP2006-188043A, it is disclosed that one dot (super droplet) is formed by discharging a plurality of ink droplets (sub drops) by continuously applying a series of driving pulses within the same pixel period (within the same driving period) a plurality of times and integrating the ink droplets during flight or after landing.

Furthermore, in JP2009-286108A, an apparatus is disclosed which can suppress the generation of a satellite liquid droplet by compressing a pressure chamber in two steps by raising the voltage, which has been lowered in a first voltage change process, in two steps of a second voltage change process and a third voltage change process.

In addition, in JP2009-274433A, an apparatus is disclosed which can suppress the generation of a satellite liquid droplet by adjusting the speed of a liquid droplet.

SUMMARY OF THE INVENTION

In order to discharge liquid droplets most efficiently in the ink jet method, a driving waveform is designed such that the pulse width is a half of the resonant period Tc. By using the driving waveform designed as above, many of the shapes of liquid droplets during flight are disordered, whereby the image quality deteriorates.

Regarding such a problem, the disorder of the shapes of discharged liquid droplets during flight can be avoided by excluding the pulse width from the resonant period Tc or lowering the discharge speed of the liquid droplets. However, in the former case, it is necessary to sacrifice the discharge efficiency, and, in the latter case, it is necessary to sacrifice the accuracy of the landing position.

In the ink jet recording apparatus disclosed in JP3241352B, in a discharge type using a so-called continuous discharge waveforms (a driving waveform in which waveforms for discharging ink droplets a plurality of times are included in one discharge period), by configuring the apparatus such that the speed of an ink droplet discharged later is higher than that of an ink droplet discharged previously, the amount of shift of the landing position of a plurality of ink droplets discharged within one discharge period decreases, and it is easy to integrate the plurality of ink droplets before landing. However, there is concern that a satellite liquid droplet integrating with the main liquid droplet late is generated depending on the type of ink and differences in the discharge characteristics of heads.

In the image forming apparatus disclosed in JP2006-142588A, a satellite liquid droplet is controlled by using a technique for suppressing the reverberation of a meniscus, and the droplet speed of the satellite liquid droplet is increased by excluding the timing at which the reverberation of the meniscus is suppressed the most. Meanwhile, the reverberation of the meniscus remains, and accordingly, there is concern that the discharge of the main liquid droplet is affected by a successive driving waveform.

In the liquid droplet discharging apparatus disclosed in JP2006-188043A, a discharge type using a continuous waveform is realized by cancelling a pressure wave for the discharge of each sub droplet through suppression of the reverberation of the meniscus using a cancel pulse (a second contraction pulse). However, since it takes a long time to suppress the reverberation of the meniscus in such a type, the apparatus is not appropriate for the implementation of high speed. The apparatuses disclosed in JP2009-286108A and JP2009-274433A do not solve all such concepts.

The present invention is devised in consideration of such situations, and an object thereof is to provide a driving device of a liquid discharging head, a liquid discharging apparatus, and an ink jet recording apparatus that are capable of realizing a desired dot shape by suppressing the generation of the meniscus without sacrificing the discharge efficiency or the landing accuracy.

In order to achieve the above-described object, according to the present invention, there is provided a driving device for a liquid discharging head that discharges a liquid droplet from a nozzle by supplying a driving signal to a discharge energy generating element. The driving device includes: a driving signal generating unit that generates the driving signal used for operating the discharge energy generating element that is disposed in correspondence with the nozzle of the liquid discharging head. The driving signal includes a plurality of discharge pulses used for performing discharging a plurality of times in one recording period, a final pulse of the plurality of discharge pulses is configured such that a wave height change time of a dead-end side wave height changing portion of the final pulse is equal to or longer than a quarter of a resonant period Tc, and at least one of the plurality of discharge pulses is configured such that a pulse width represented by a time from a starting end of the pulse to a starting end of the dead-end side wave height changing portion is a half of the resonant period Tc.

According to an embodiment of the present invention, in a case where discharging is performed a plurality of times in one recording period, and one pixel (one dot) is recorded by using a plurality of droplets, by configuring the wave height change time of a rear-end side wave height change part of the final pulse of a plurality of discharge pulses to be equal to or longer than a quarter of the resonant period Tc and configuring the pulse width of the plurality of discharge pulses to be a half of the resonant period Tc, the generation of a satellite liquid droplet can be prevented without changing the amount of discharged liquid droplet and the speed of the discharged droplet.

DESCRIPTION OF THE PREFERRED EMBODIMENTS

Hereinafter, preferred embodiments of the present invention will be described in detail with reference to the accompanying drawings.

Description of Driving Waveform

Figure 1:
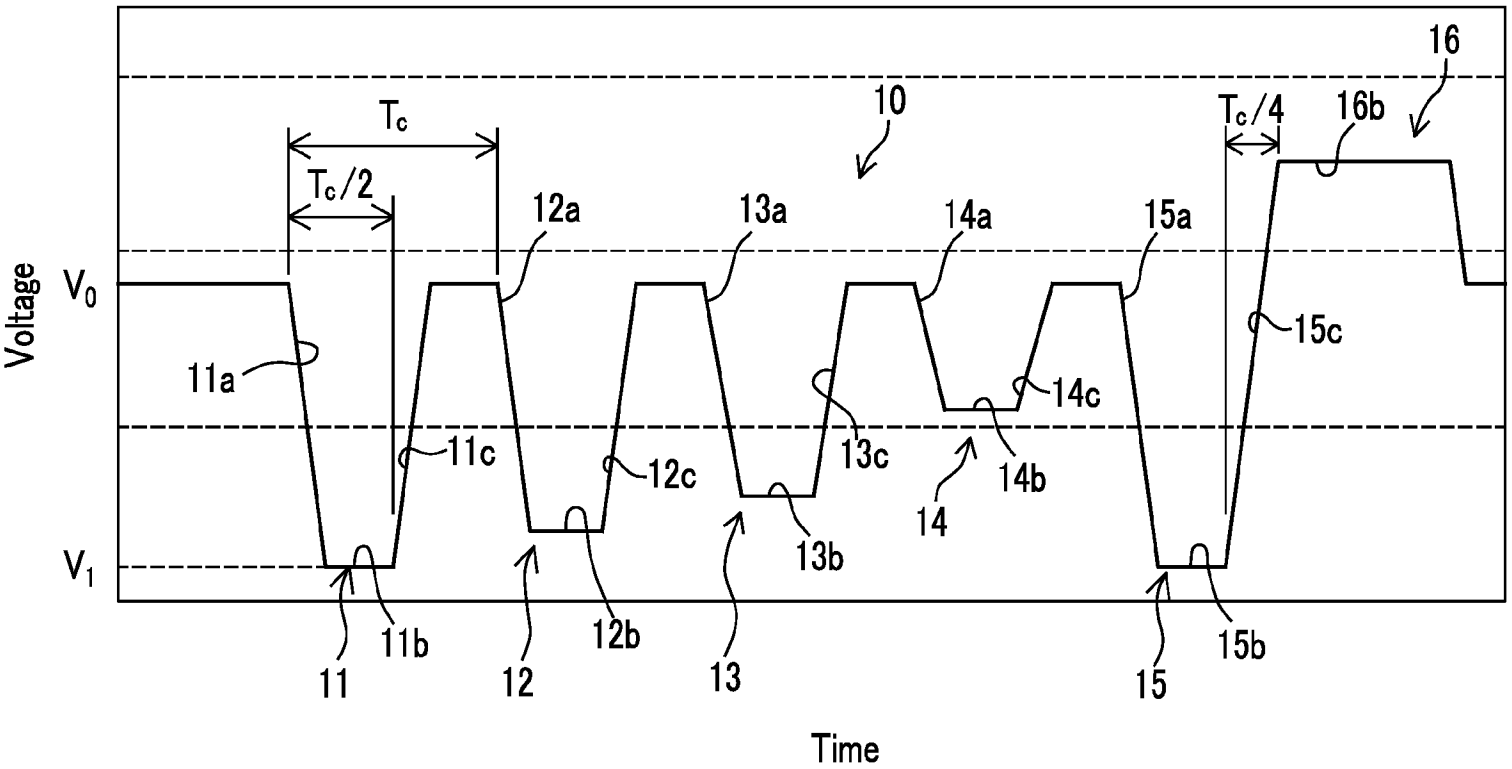
FIG. 1 is a waveform diagram that illustrates an example of the driving waveform of an ink jet head according to an embodiment of the present invention.

FIG. 1 is a waveform diagram that illustrates an example of the driving waveform of an ink jet head according to an embodiment of the present invention. The driving waveform 10 is a driving waveform in which a plurality of discharge pulses 11 to 15 is continuous within one recording period that is responsible for dot recording of one pixel on a recording medium.

In the driving waveform 10 illustrated in FIG. 1, a reverberation suppressing (settling down) pulse 16 that settles down a meniscus oscillation (reverberation) is added after the final pulse 15 so as to be continuous thereto. Here, a term "one recording period" may be referred to as "one printout period" or "one printing period" in the field.

FIG. 1 illustrates an example of a five continuous discharge type in which five pulses 11, 12, 13, 14, and 15 are continuous. Each of the pulses 11 to 15 is a waveform of a so-called pull-push type, and one discharge operation is performed for the application of one pulse.

The leading pulse (first pulse) 11 of the driving waveform 10 is configured to include: a first signal element 11*a* that drives a "pulling" operation" of transforming a piezoelectric element (denoted by reference numeral 253 in FIG. 23) in a direction expanding the volume of a pressure chamber (denoted by reference numeral 252 in FIGS. 21A and 21B) that communicates with a nozzle (not illustrated in FIG. 1, but denoted by reference numeral 251 in FIGS. 21A and 21B); a second signal element 11*b* that maintains (keeps) the state in which the pressure chamber is expanded by the pulling operation; and a third signal element 11*c* that drives a "pushing" operation of transforming the piezoelectric element in the direction contracting the pressure chamber.

The first signal element 11*a* is a falling waveform portion in which the electric potential is lowered from a reference electric potential $V_0$. The second signal element 11*b* is a waveform portion in which an electric potential $V_1$ that is lowered in the first signal element 11*a* is maintained, and the third signal element 11*c* is a rising waveform portion in which the electric potential rises from the electric potential ($V_1$) of the second signal element 11*b* to the reference electric potential.

Similarly, the second pulse 12, the third pulse 13, the fourth pulse 14, and the fifth pulse (final pulse) 15 following the leading pulse 11 respectively have signal elements corresponding to operations of "pulling", "maintaining", and "pushing".

Similarly to 11*a*, 11*b*, and 11*c* described for the leading pulse 11, the signal elements of "pulling", "maintaining", and "pushing" are represented by adding subscripts "a", "b", and "c" to the ends of the reference numerals representing the pulses 12 to 15.

In the description presented here, for convenience of the description, electric potential differences of the second signal elements 11*b* to 15*b* of the pulses 11 to 15 with respect to the reference electric potential $V_0$ will be referred to as "voltage amplitudes" or "wave heights". In other words, an electric potential difference ($V_0-V_1$) between the reference electric potential $V_0$ and the electric potential $V_1$ of the second signal element 11*b* will be referred to as a "voltage amplitude" or a "wave height" of the first pulse 11.

Similarly, the electric potential $V_2$ (not illustrated in the figure) of the second signal element 12*b* of the second pulse 12, the electric potential $V_3$ (not illustrated in the figure) of the second signal element 13*b* of the third pulse 13, the electric potential $V_4$ (not illustrated in the figure) of the second signal element 14*b* of the fourth pulse 14, and the electric potential $V_5$ (not illustrated in the figure) of the second signal element 15*b* of the fifth pulse 15 with respect to the reference electric potential $V_0$ will be described to as "voltage amplitudes" or "wave heights" of the pulses 12 to 15.

In the driving waveform 10 of this example, the voltage amplitudes (wave heights) of the successive pulses 12 to 14 gradually decrease from the voltage amplitude (wave height) of the leading pulse 11, and the voltage amplitude of the final pulse 15 is larger than that of the leading pulse 11.

In other words, the voltage amplitude of the final pulse 15 is larger than the voltage amplitudes of the other preceding pulses 11 to 14. By applying the pulses 11 to 15 to the piezoelectric element, liquid droplets are discharged from the nozzle, and accordingly, discharge operations of which the number is the same as the number of discharge pulses included within one recording period are performed in one recording period.

In the example illustrated in FIG. 1, liquid droplets are consecutively discharged by five consecutive discharge operations in one recording period, and the discharged liquid droplets (four droplets) are integrated together at the time of landing on a recording medium. As the liquid droplet (integrated liquid droplet) that has been integrated adheres to the recording medium, one dot is recorded.

In the driving waveform 10 illustrated in FIG. 1, a rising time (a time in which the wave height of the rising waveform portion 15*c* changes) of the final pulse (fifth pulse) 15 is a quarter of a resonant period Tc. Here, the "rising time" of the final pulse 15 is a time in which a change from the electric potential $V_5$ (not illustrated in the figure) of the second signal element 15*b* of the final pulse 15 to the electric potential $V_6$ (not illustrated in the figure) of the second signal element 16*b* of the reverberation suppressing pulse 16 is made.

Figure 2:
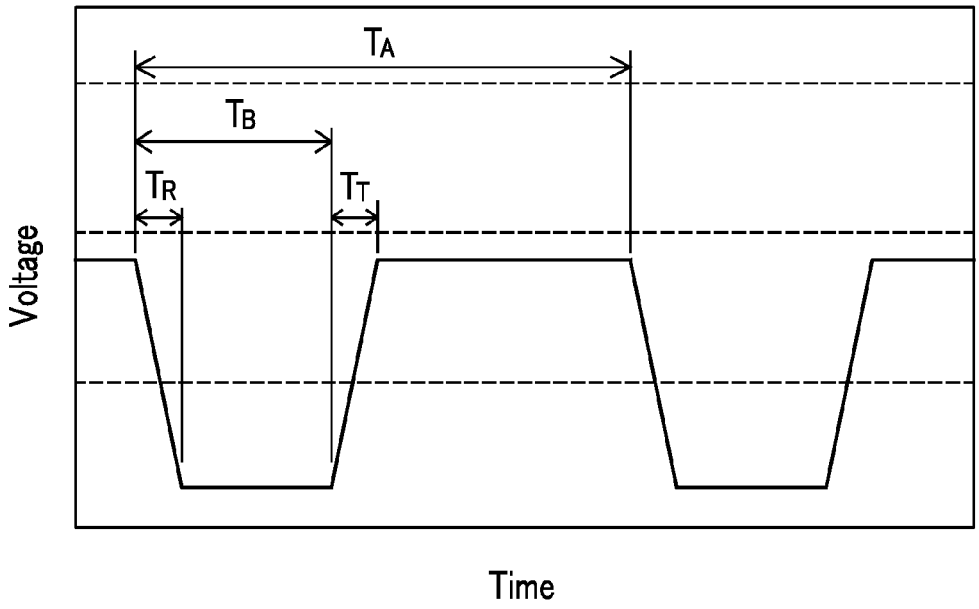
FIG. 2 is a schematic diagram that illustrates parameters of a driving waveform that are applied to an embodiment of the present invention.

Here, parameters of the driving waveform described in FIG. 1 and hereinafter will be described. FIG. 2 is a schematic diagram that illustrates the parameters of the driving waveform. In the figure, a wave height change time $T_R$ of a falling waveform portion (a waveform portion in which "a" is added to the end of a reference numeral in FIG. 1) is a "falling time", and a wave height change time $T_T$ of a rising waveform portion (a waveform portion in which "c" is added to the end of the reference numeral in FIG. 1) is a "rising time".

In addition, a time $T_B$ from the starting end of a pulse to the starting end of the falling waveform portion (a wave height changing portion on the dead end side) of the pulse is a "pulse width", and a time $T_A$ from the starting end of the previous pulse to the starting end of the next pulse is a "pulse interval".

Referring back to FIG. 1, the pulse widths of the first pulse 11 to the fifth pulse 15, which configure the driving waveform 10, are respectively a half of the resonant period Tc, and the pulse widths thereof are respectively the resonant period Tc. As above, by using a resonance phenomenon of the meniscus by configuring the pulse width and the pulse interval to be in correspondence with the resonant period Tc, liquid droplet discharge having high efficiency can be performed (to be described in detail later).

In the example illustrated in FIG. 1, the rising time of the first pulses 11 to 14 is longer than that of the fifth pulse 15.

According to one technical aspect of the present invention, in a continuous pulse waveform, while the generation of satellite liquid droplets are prevented, a satisfactory flying shape of discharged liquid droplets is satisfied, the amount of discharge is secured by performing high efficiency discharge using the resonance, and predetermined droplet accuracy is secured by maintaining a predetermined droplet speed.

Figure 3:
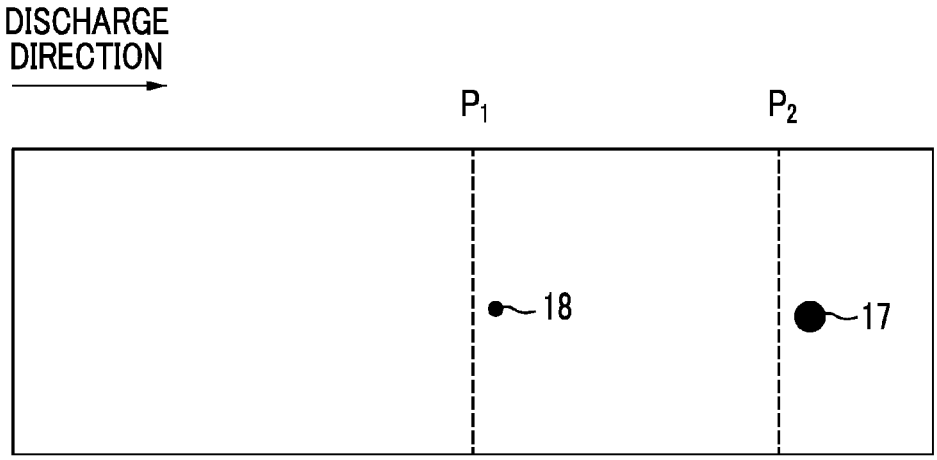
FIG. 3 is a schematic diagram that illustrates a discharge state using the driving waveform illustrated in FIG. 1.

FIG. 3 is a schematic diagram that illustrates a discharge state using the driving waveform illustrated in FIG. 1 and is acquired by imaging a flying space after 70 microseconds from the discharge timing (the dead end of the final pulse 15 illustrated in FIG. 1).

In the figure, a nozzle surface is disposed on the remote left side not illustrated in the figure, a medium is disposed on the remote right side, and a direction from the left side to the right side is the liquid droplet discharging direction (traveling direction). In FIG. 3, $P_1$ denotes a position that is located apart from the nozzle surface by 300 micron, and $P_2$ denotes a position that is located apart from the nozzle surface by 500 micron. Here, a distance from the nozzle surface to the medium surface (the landing surface of liquid droplets) is 700 micron.

When liquid droplets are discharged by using the driving waveform 10 illustrated in FIG. 1, five liquid droplets are discharged in accordance with the first pulse 11 to the fifth pulse 15. As illustrated in FIG. 3, the five liquid droplets are integrated during flight so as to form a main liquid droplet 17. On the other hand, there are liquid droplets formed as satellite liquid droplets 18 that are not integrated as the main liquid droplet 17 during flight so as to be separated therefrom.

In a case where a distance between a main liquid droplet 17 and a satellite liquid droplet 18 during flight is close to some degree, the main liquid droplet 17 and the satellite liquid droplet 18 are integrated together on a medium. In addition, even in a case where a satellite liquid droplet 18 is landed at a position close to the landing position of the main liquid droplet 17, when the landing position of the satellite liquid droplet 18 is within a range of a dot size that is formed by the main liquid droplet 17 or within a range of the error of a dot size, the satellite liquid droplet 18 is visually recognized to be substantially integrated with the main liquid droplet 17.

In order for a main liquid droplet 17 and a satellite liquid droplet 18 to be integrated together, it is necessary for a value acquired by multiplying the conveyance speed of a medium and a difference between times at which the main liquid droplet 17 and the satellite liquid droplet 18 land on the medium to be equal to or less than the radius of a dot that is formed by the main liquid droplet 17. As a driving waveform that satisfies such a condition, it is required that the main liquid droplet 17 and the satellite liquid droplet 18 should be close to each other.

In the discharge state illustrated in FIG. 3, since the distance between the main liquid droplet 17 and the satellite liquid droplet 18 satisfies the above-described condition, the disturbance of the dot shape due to the satellite liquid droplet 18 is suppressed, and a desired dot shape close to a perfect circle is realized.

Figure 4:
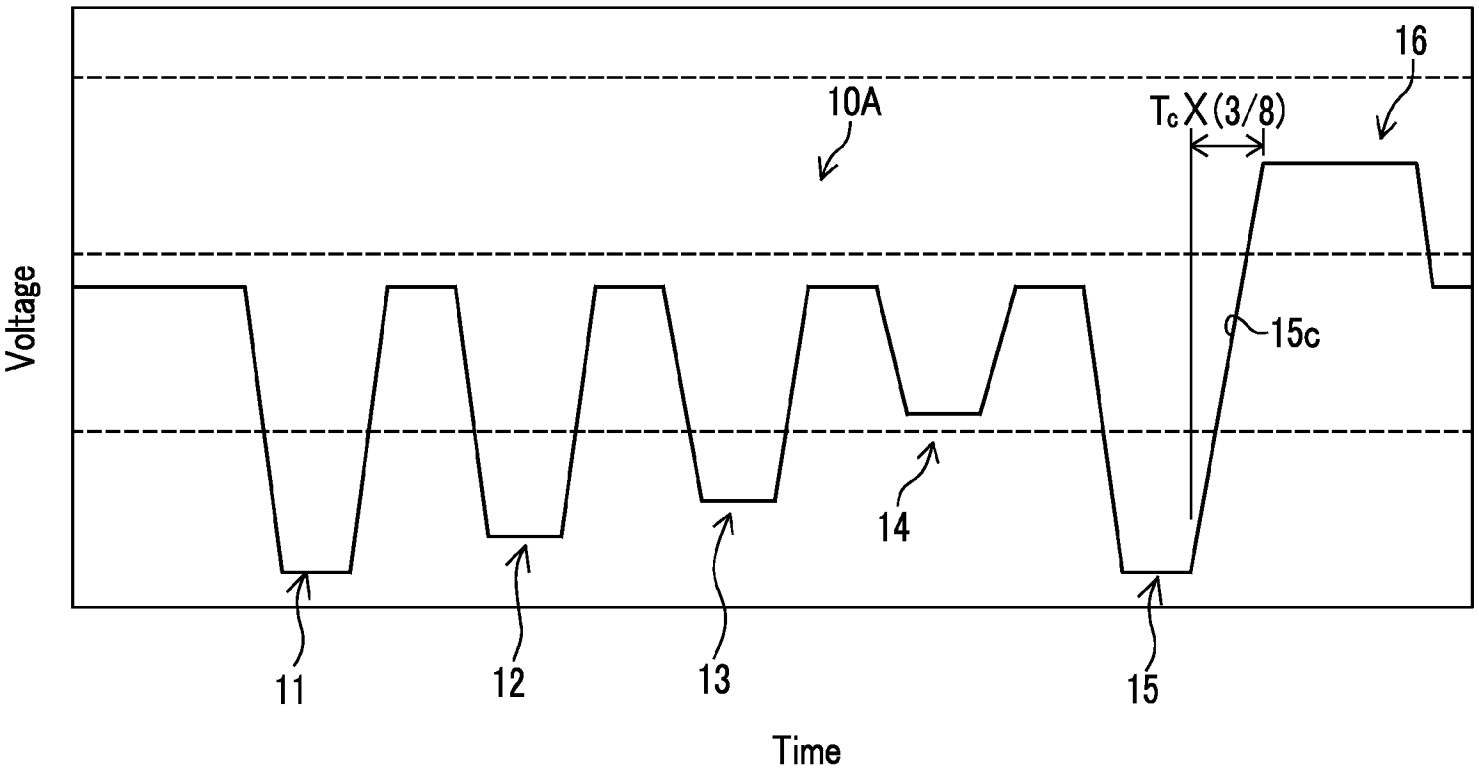
FIG. 4 is a waveform diagram that illustrates a driving waveform in a case where a rising time of the final pulse is configured to be longer than that of the driving waveform illustrated in FIG. 3.

FIG. 4 is a waveform diagram that illustrates an example of a driving waveform in which the rising time of the final pulse 15 is configured to be longer than that of the driving waveform 10 illustrated in FIG. 1. The rising time of the final pulse 15 of the driving waveform 10A illustrated in FIG. 4 is ⅜ times the resonant period Tc. In addition, the first pulse 11 to the fourth pulse 14 and the reverberation suppressing pulse 16 are the same as those of the driving waveform 10 illustrated in FIG. 3.

Figure 5:
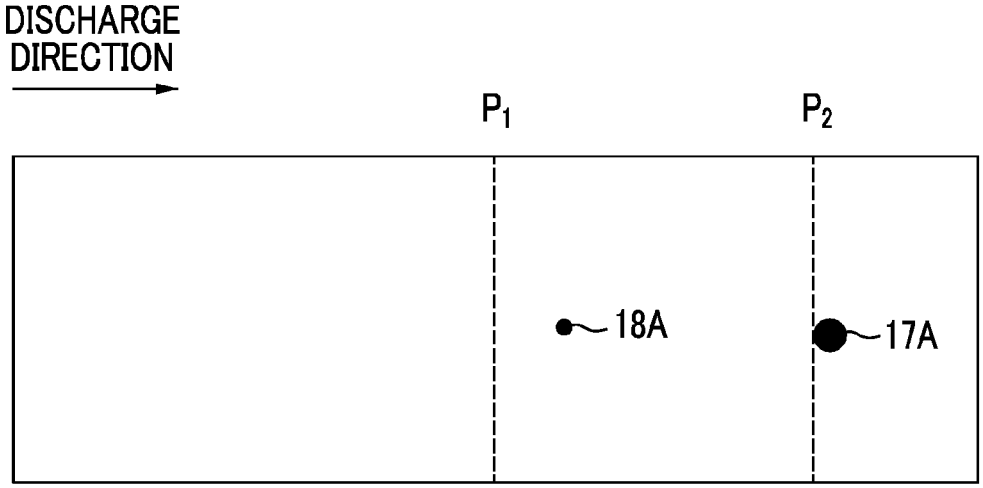
FIG. 5 is a schematic diagram that illustrates a discharge state using the driving waveform illustrated in FIG. 4.

FIG. 5 is a schematic diagram (a diagram corresponding to FIG. 3) that illustrates a discharge state using the driving waveform illustrated in FIG. 4, and the discharge state is illustrated in the figure in which liquid droplets are imaged under the same condition as that of FIG. 3 except for the driving waveform.

As illustrated in FIG. 5, it is acquired that a distance between a satellite liquid droplet 18A and a main liquid droplet 17A is shorter than the distance between the satellite liquid droplet 18 and the main liquid droplet 17 illustrated in FIG. 3. In other words, by configuring the rising time of the final pulse 15 to be long so as to exceed a quarter of the resonant period Tc, the satellite liquid droplet 18A can be located closer to the main liquid droplet 17A, and the disturbance of the dot shape is further suppressed, whereby a dot having a desired shape is formed.

In addition, it is understood that the reason for the shift of the position of the main liquid droplet 17A, which is illustrated in FIG. 5, to the right side in the figure with respect to the main liquid droplet 17 illustrated in FIG. 3 is that the rising time of the final pulse 15 is lengthened, and accordingly, the discharge speed of the main liquid droplet 17A is higher than that of the main liquid droplet 17 illustrated in FIG. 3.

Figure 6:
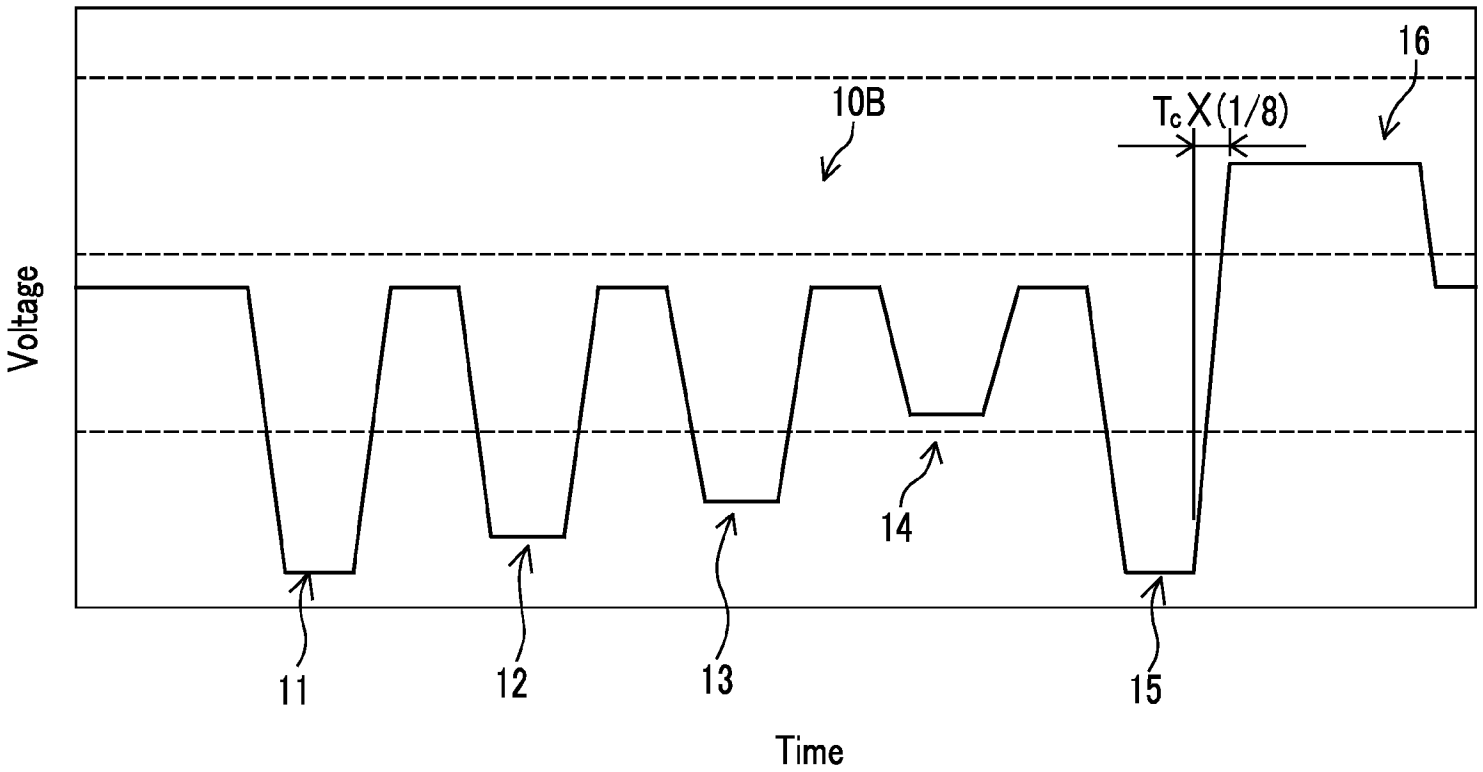
FIG. 6 is a waveform diagram that illustrates a driving waveform in a case where a rising time of the final pulse is configured to be shorter than that of the driving waveform illustrated in FIG. 3.

FIG. 6 is a waveform diagram that illustrates an example of a driving waveform in which the rising time of the final pulse 15 is configured to be shorter than that of the driving waveform 10 illustrated in FIG. 1. The rising time of the final pulse 15 of the driving waveform 10B illustrated in FIG. 6 is ⅛ times the resonant period Tc. In addition, the first pulse 11 to the fourth pulse 14 and the reverberation suppressing pulse 16 are the same as those of the driving waveform 10 illustrated in FIG. 3.

Figure 7:
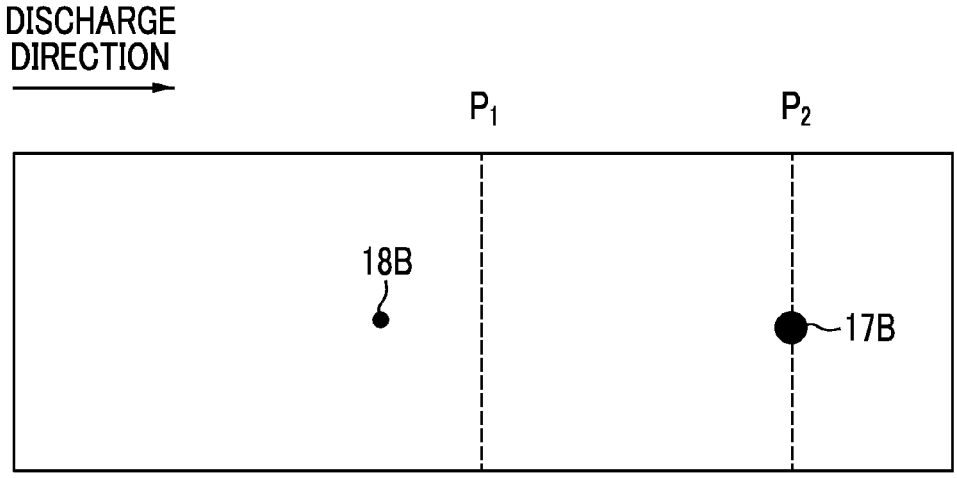
FIG. 7 is a schematic diagram that illustrates a discharge state using the driving waveform illustrated in FIG. 6 (comparative example).

FIG. 7 is a schematic diagram (a diagram corresponding to FIGS. 3 and 5) that illustrates a discharge state using the driving waveform 10B illustrated in FIG. 6, and the discharge state is illustrated in the figure in which liquid droplets are imaged under the same condition as that of FIGS. 3 and 5.

As illustrated in FIG. 7, it is acquired that a distance between a satellite liquid droplet 18B and a main liquid droplet 17B is longer than the distance between the satellite liquid droplet 18 and the main liquid droplet 17 illustrated in FIG. 3 and the distance between the satellite liquid droplet 18A and the main liquid droplet 17A illustrated in FIG. 5.

As illustrated in FIG. 7, in a case where the main liquid droplet 17B and the satellite liquid droplet 18B are separated away from each other to some degree or more, they individually land on the medium. In that case, a dot that is deformed to be not a perfect circle may be visually recognized, or the satellite liquid droplet 18B may be individually visually recognize, whereby the printing quality deteriorates.

In addition, it is understood that the reason for the shift of the position of the main liquid droplet 17B, which is illustrated in FIG. 7, to the left side in the figure is that the rising time of the final pulse 15 is shortened, and accordingly, the discharge speed of the main liquid droplet 17B is lower than those of the main liquid droplet 17, which is illustrated in FIG. 3, or the main liquid droplet 17A that is illustrated in FIG. 5.

The discharge state illustrated in FIGS. 3, 5, and 7 is acquired, and the conditions other than the driving waveform are as bellow.

Condition of Ink Jet Head: diameter of nozzle is 16 micrometer

Discharge Frequency: 5 kHz

Driving Voltage: 22 volt (maximum wave height value)

Ink: viscosity is 5 centipoise (millipascal seconds), and surface tension is 30 millinewton per meter As above, when the diagrams illustrated in FIGS. 1 and 3 to 7 are summarized, by configuring the rising time of the final pulse of the driving waveform that is configured by a plurality of discharge pulses (continuous pulses) to be equal to or longer than a quarter of the resonance period Tc, a main liquid droplet in which consecutive liquid droplets are integrated and satellite liquid droplets that are not integrated with the main liquid droplet but fly separately can be positioned to be close to each other during flight.

In addition, by configuring the pulse width of each pulse that configures the continuous pulses to be a half of the resonant period Tc, discharge using meniscus resonance is performed with high efficiency, whereby a predetermined amount of discharged liquid droplet is secured. Furthermore, since the discharge speed does not decrease, predetermined landing accuracy is secured.

MODIFIED EXAMPLES

Modified Example 1

Figure 8:
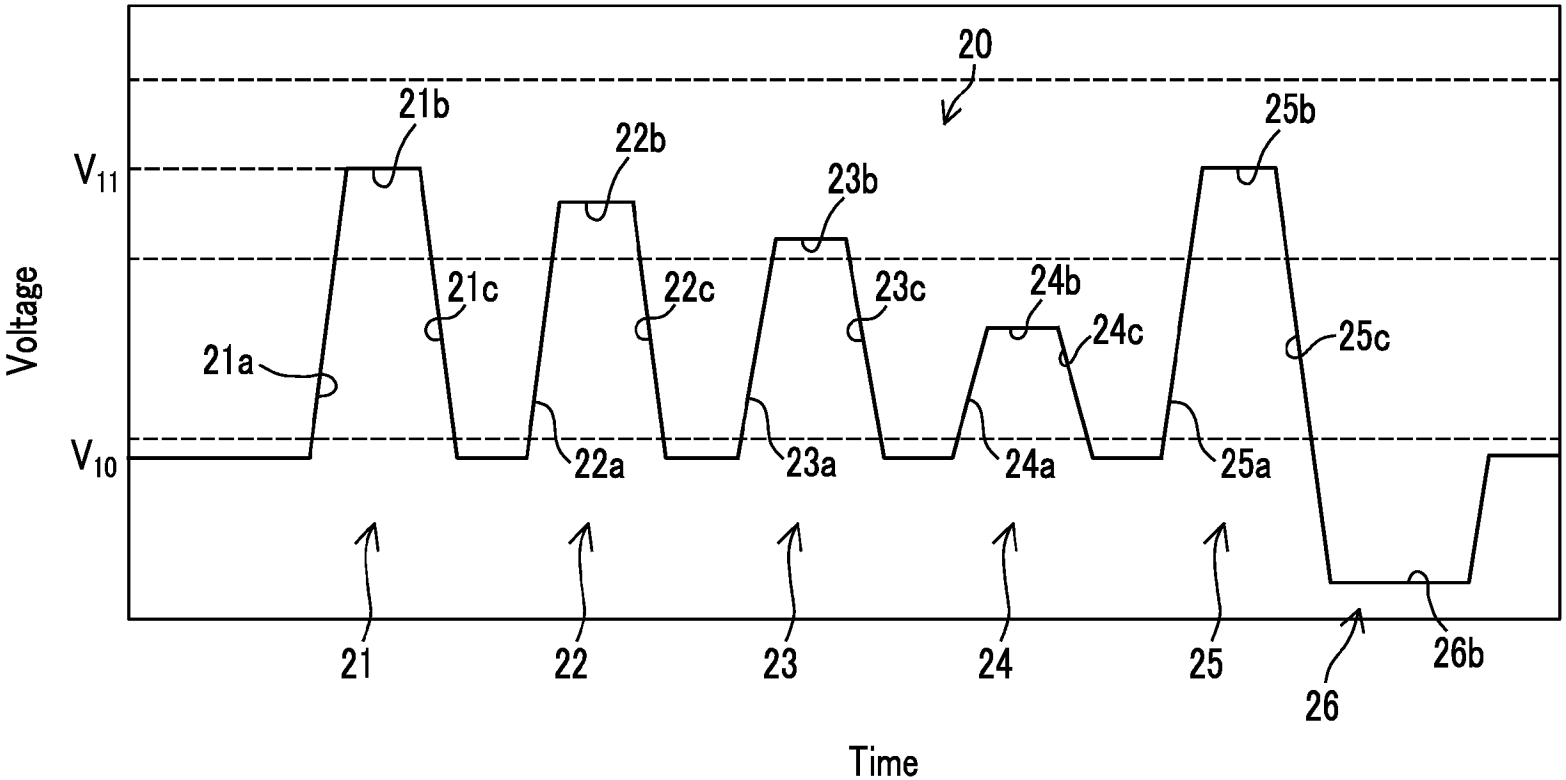
FIG. 8 is a waveform diagram that illustrates another form of the driving waveform illustrated in FIG. 3.

Next, modified examples of the above-described driving waveform will be described. FIG. 8 is a waveform diagram that illustrates another form of the driving waveform 10 illustrated in FIG. 1.

The driving waveform 20 illustrated in FIG. 8 is acquired by inverting the logic of the driving waveform 10 illustrated in FIG. 1. In other words, the driving waveform 20 causes the pressure chamber to expand in the rising waveform portions (first signal elements 21*a*, 22*a*, 23*a*, 24*a*, and 25*a*) of the first pulse 21 to the fifth pulse and causes the pressure chamber to contract in the falling waveform portions (third signal elements 21*c*, 22*c*, 23*c*, 24*c*, and 25*c*).

In other words, the driving waveform 10 (10A and 10B) illustrated in FIG. 1 (FIGS. 4 and 6) and the driving waveform 20 illustrated in FIG. 8 have the relation in which "rising" and "falling" of the pulses 11 to 15 and the pulses 21 to 25 are reversed.

In other words, as a common concept of the "falling time" of the driving waveform 10 illustrated in FIG. 1 and the "rising time" of the driving waveform 20 illustrated in FIG. 8, "$T_R$" illustrated in FIG. 2 can be perceived as a "wave height change time of the wave height changing portion on the starting end side".

In addition, as a common concept of the "rising time" of the driving waveform 10 illustrated in FIG. 1 and the "falling time" of the driving waveform 20 illustrated in FIG. 8, "$T_T$" illustrated in FIG. 2 can be perceived as a "wave height change time of the wave height changing portion on the dead end side".

In the driving waveform 20 illustrated in FIG. 8, the falling time of the final pulse 25 is equal to or longer than a quarter of the resonance period Tc, and, according to such a configuration, the generation of satellite liquid droplets can be prevented without changing the amount of the discharged liquid droplet and the speed of the liquid droplet.

Modified Example 2

Figure 9:
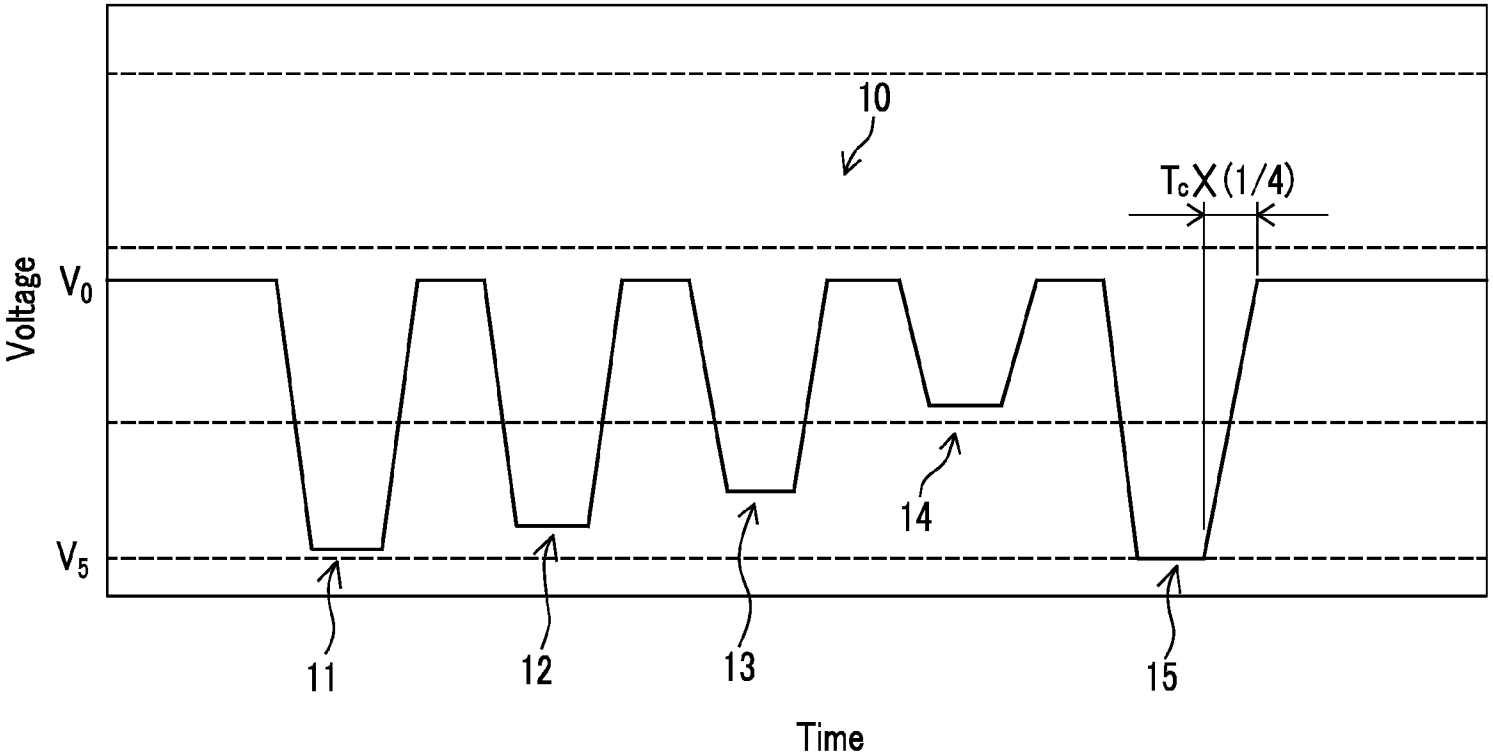
FIG. 9 is a waveform diagram that illustrates a driving waveform acquired by excluding a reverberation suppressing pulse from the driving waveform illustrated in FIG. 3.

FIG. 9 is a waveform diagram that illustrates a driving waveform acquired by excluding the reverberation suppressing pulse 16 from the driving waveform 10 illustrated in FIG. 1. The rising time of the final pulse 15 of the driving waveform 10, in which the reverberation suppressing pulse 16 is excluded, illustrated in FIG. 9 is a time until the electric potential changes to the reference electric potential $V_0$ from the electric potential $V_5$ of the second signal element 15*b* of the final pulse 15.

According to such a configuration, although it is difficult to suppress the reverberation of the meniscus, the generation of a satellite liquid droplet can be prevented by locating a main liquid droplet and the satellite liquid droplet during flight to be close to each other. In addition, the same advantages can be acquired by inverting the logic of the driving waveform 10 illustrated in FIG. 9 as illustrated in FIG. 8.

Pulse Width and Pulse Interval of Discharge Pulse

Figures 10A, 10B:
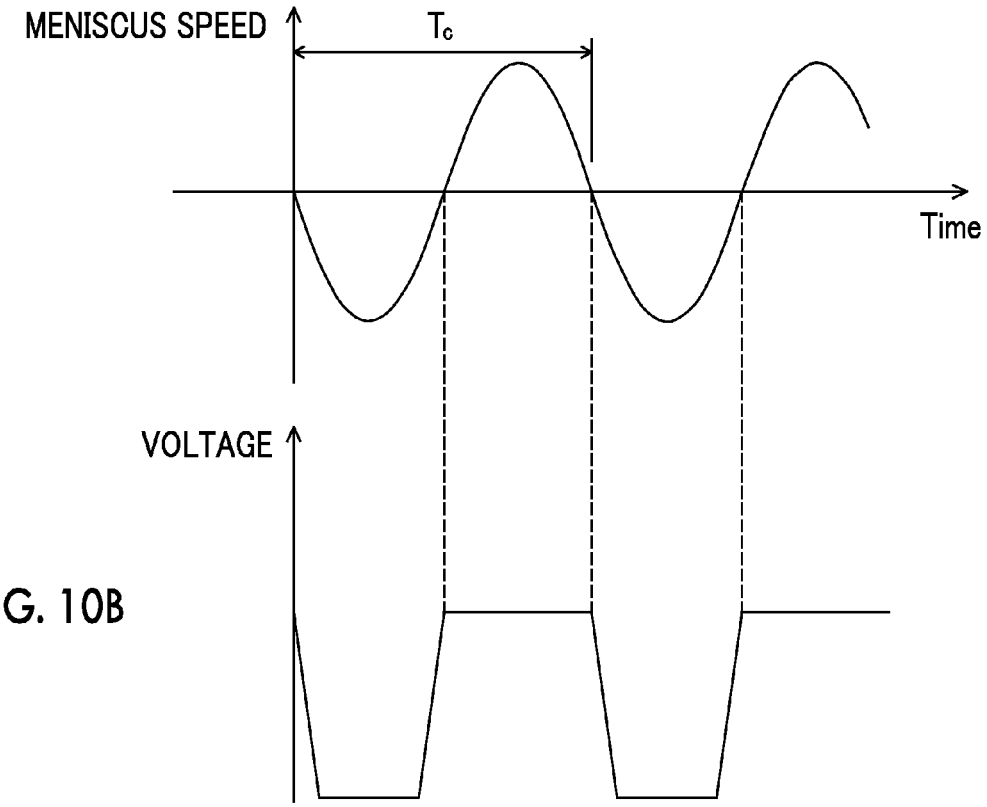
FIG. 10A is a waveform diagram that illustrates a pressure change.
FIG. 10B is a waveform diagram that illustrates the waveform of an applied driving voltage.

FIGS. 10A and 10B are graphs that illustrate a pressure change (a change in the speed of the meniscus) inside the nozzle (inside the pressure chamber) according to the application of a representative pulling-pushing waveform to an ink jet head. FIG. 10A is a waveform that illustrates a pressure change, and FIG. 10B illustrates the waveform of an applied driving voltage.

In the case of an ink jet head of a piezo-jet type, a structure is formed in which a piezoelectric element is placed in a pressure chamber that communicates with a nozzle hole (discharge opening) in a discharge mechanism of one nozzle, and liquid droplets are discharged from the nozzle hole by applying a pressure change to liquid disposed inside the pressure chamber by driving the piezoelectric element. In order to directly use the pressure oscillation for discharging, it is preferable that a pulse waveform having a configuration according to a sine wave of the pressure oscillation when liquid droplets are strongly discharged from the nozzle hole.

In the waveform illustrated in FIG. 10B, when a voltage is lowered from the reference electric potential, the pressure chamber expands, and accordingly, the pressure decreases, whereby the meniscus placed inside the nozzle is drawn in a direction of the pressure chamber (a direction opposite to the discharge direction).

By maintaining the drawing voltage to be constant after the operation of drawing the meniscus is started by applying the "drawing" waveform element, the meniscus oscillates with a natural oscillation period (resonant period Tc) of the oscillation system. When the pressure chamber is contracted at an exact time when the speed in the discharge direction is zero in accordance with the oscillation of the meniscus, the liquid droplets are accelerated the most. By matching the speed (motion) of the meniscus and the cycle of the drawing and pressing according to the driving waveform, efficient discharge can be performed.

As illustrated in FIG. 10A, since one cycle of the meniscus oscillation is one resonant period Tc, the efficiency is highest in a case where pulse width is broken at an approximate half thereof (Tc/2). In addition, it is preferable that the pulse interval of a second discharge pulse is set such that the drawing and pushing waveform elements overlap with each other in accordance with the drawing and the accelerated movement according to the oscillation of the meniscus that are generated by applying the first discharge pulse.

In other words, it is preferable that the pulse interval coincides with a positive integral multiple of the resonant period Tc, and it is preferable that the width of the pulse is configured to be $\{(2\times n)-1\}/2$ of the resonant period Tc (here, n is a positive integer).

As described above, an example is formed in which the pulse interval of the driving waveform 10 illustrated with reference to FIG. 1 almost coincides with the resonant period Tc, and the pulse width thereof almost coincides with Tc/2.

Specifying Resonant Period Tc

The head resonant period (Helmholtz natural oscillation period) Tc is a natural period of the whole oscillation system that is determined based on the ink flowing path system, ink (reverberation element), the dimension of the piezoelectric element, the material, the physical property, and the like. The resonant period Tc can be acquired through a calculation that is based on the design values (including the physical property of used ink) of the head.

In addition, a method of acquiring the resonant period is not limited to the method in which the resonant period is estimated based on the design values of the head, but there is also a method in which the resonant period Tc is measured through an experiment. For example, as the driving waveform, a simple rectangular wave is used, and the resonant period Tc can be acquired by checking the liquid droplet speed and the droplet amount while the pulse width of the rectangular wave is gradually changed.

The liquid droplet speed and the liquid amount reach a peak in accordance with a change in the pulse width, and at which the value changes from increasing to decreasing.

In addition, as the driving waveform, a continuous rectangular waveform in which rectangular waves are continuous may be used. In other words, the pulse interval of the continuous rectangular wave is gradually changed, and the resonant period Tc can be acquired in the viewpoint of an increase in the droplet speed according to the successive pulse or a change in the droplet amount.

Furthermore, the resonant period Tc that is acquired by using the measurement method described above as an example has a variation in a range that depends on the measurement method. In specifying the resonant period Tc, it should be interpreted that a variation is allowed in a range that depends on a used specifying method such as an estimation (calculation) method that is based on the design values of the head, the measurement method described in the example presented above, or the like.

Behavior of Discharge Operation

As illustrated in FIG. 1, the driving waveform 10 is configured to include five discharge pulses (11 to 15) within one recording period. A first liquid droplet is strongly pushed out by the leading first pulse 11, and thereafter, the voltage amplitude is gradually decreased from the leading pulse 11 within a pulse train up to the successive second, third and, fourth pulses 12, 13, and 14.

The final fifth pulse (final pulse) 15 causes a final liquid droplet, which has a voltage amplitude larger than that of the first pulse 11, to be discharged at a speed catching up discharged liquid droplets (preceding liquid droplets) according to the preceding pulses (first to fourth pulses).

In addition, in the driving waveform 10 illustrated in FIG. 1, a reverberation pulse 16 that suppresses (settles down) the meniscus oscillation (reverberation) is added after the fifth pulse 15.

The first liquid droplet is pushed out in accordance with the third signal element 11*c* of the first pulse 11. The liquid droplet that is discharged second is pushed out in accordance with the third signal element 12*c* of the second pulse 12, and liquid droplets that are discharged third, fourth, and fifth are pushed out in accordance with the third signal element 13*c* of the third pulse 13, the third signal element 14*c* of the fourth pulse 14, and the third signal element 15*c* of the fifth pulse 15.

The successive pulses (12 to 15) that are applied after the first pulse 11 accelerate liquid by using the oscillation (reverberation) of the meniscus according to the application of the preceding pulse. Accordingly, in a case where the voltage of the successive pulse is slightly lowered than the voltage of the preceding pulse, the successive liquid droplet catches up with the preceding liquid droplet.

In other words, liquid droplets that are discharged second and third advance in the pulling thread of the first liquid droplet (leading liquid droplet) and catches up with the leading liquid droplet so as to be integrated together. In addition, like the fourth discharge, in a case where the wave height value of the fourth pulse 14 is extremely lowered than that of the third pulse 13 (see FIG. 1), although the leading liquid droplet cannot be caught up, the corresponding liquid droplet is integrated with the final liquid droplet that is discharged in accordance with the final pulse (fifth pulse) 15.

In addition, in the case of a continuous pulses, since acceleration is performed by using the reverberation (meniscus oscillation) according to the preceding pulse, the droplet speed of discharged liquid according to each pulse cannot be necessarily specified based on only the magnitude relation of the wave height values of the pulses.

However, in a case where one of the first to fifth pulses is used alone (in a case where a single discharge operation is performed by applying a single pulling-pushing pulse), the droplet speed, the discharge force, and the discharge energy increase or decrease in accordance with the wave height value of the pulse.

Accordingly, in a case where each pulse within a remaining pulse train (the first pulse 11 to the fourth pulse 14) acquired by excluding the final pulse 15 from the continuous pulses 11 to 15 as illustrated in FIG. 1 is used alone, it is arranged so as to have the relationship of gradually lowering the discharge speed, gradually decreasing the discharge energy, or gradually weakening the discharge force.

In addition, in a case where the fifth pulse (final pulse) 15 is used alone, compared to other preceding pulses (11 to 14), it is arranged so as to have the relationship of raising the discharge the most, increasing the discharge energy the most, or strengthening the discharge force the most.

Example of Case Where Droplet is Hit With Droplet Type Being Differently Set

Figure 11A:
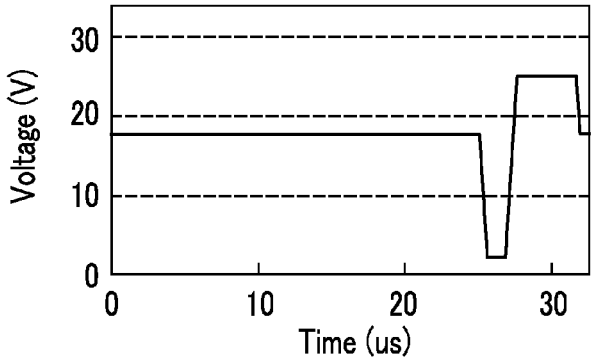
FIGS. 11A to 11C are waveform diagrams that illustrate examples of a driving waveform that is used in a case where a droplet is hit with the amount of the droplet being changed.
Figure 11B:
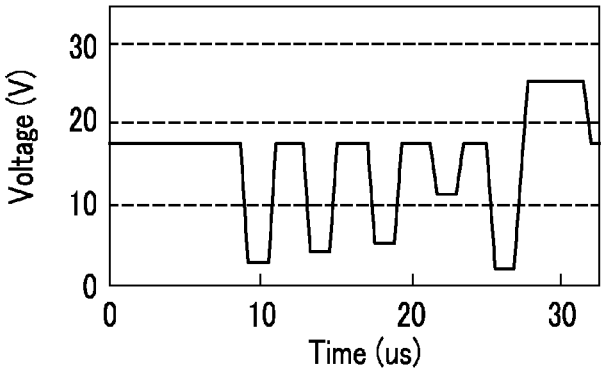
Figure 11C:
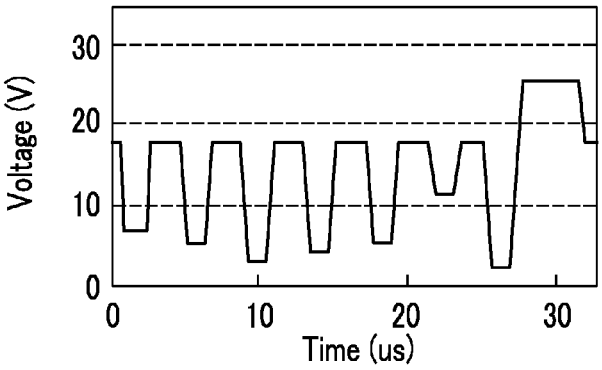

FIGS. 11A to 11C are examples of the driving waveform that is used in a case where a droplet is hit with the amount of the droplet within one pixel being differently set. Here, an example of a case will be described in which droplets are divided into three types of droplet sizes including a small droplet, a medium droplet, and a large droplet by using a part of a plurality of discharge pulses that configure a driving waveform of one recording period from the rear side.

FIG. 11A is a waveform diagram corresponding to a small droplet, FIG. 11B is a waveform diagram corresponding to a medium droplet, and FIG. 11C is a waveform diagram corresponding to a large droplet. For the waveform (FIG. 11B) of the medium droplet that is assumed to have the highest use frequency, the configuration of the continuous pulse waveform described with reference to FIG. 1 is employed.

In other words, by adjusting the voltage amplitude of each pulse, the medium droplet is used for implementation of a low voltage and the adjustment of the discharge efficiency. In addition, in the final pulse, by taking the contraction of the pressure chamber to be stronger than the expansion, a voltage level is secured for which a preceding droplet can be integrated. As above, it is also a preferred embodiment in which the discharge efficiency of the final pulse is increased by combining the reverberation suppressing part.

The waveform (FIG. 11A) of the small droplet is acquired by selecting only a final pulse and a reverberation suppressing pulse from the waveform (FIG. 11B) of the medium droplet or the waveform (FIG. 11C) of the large droplet.

Figure 12:
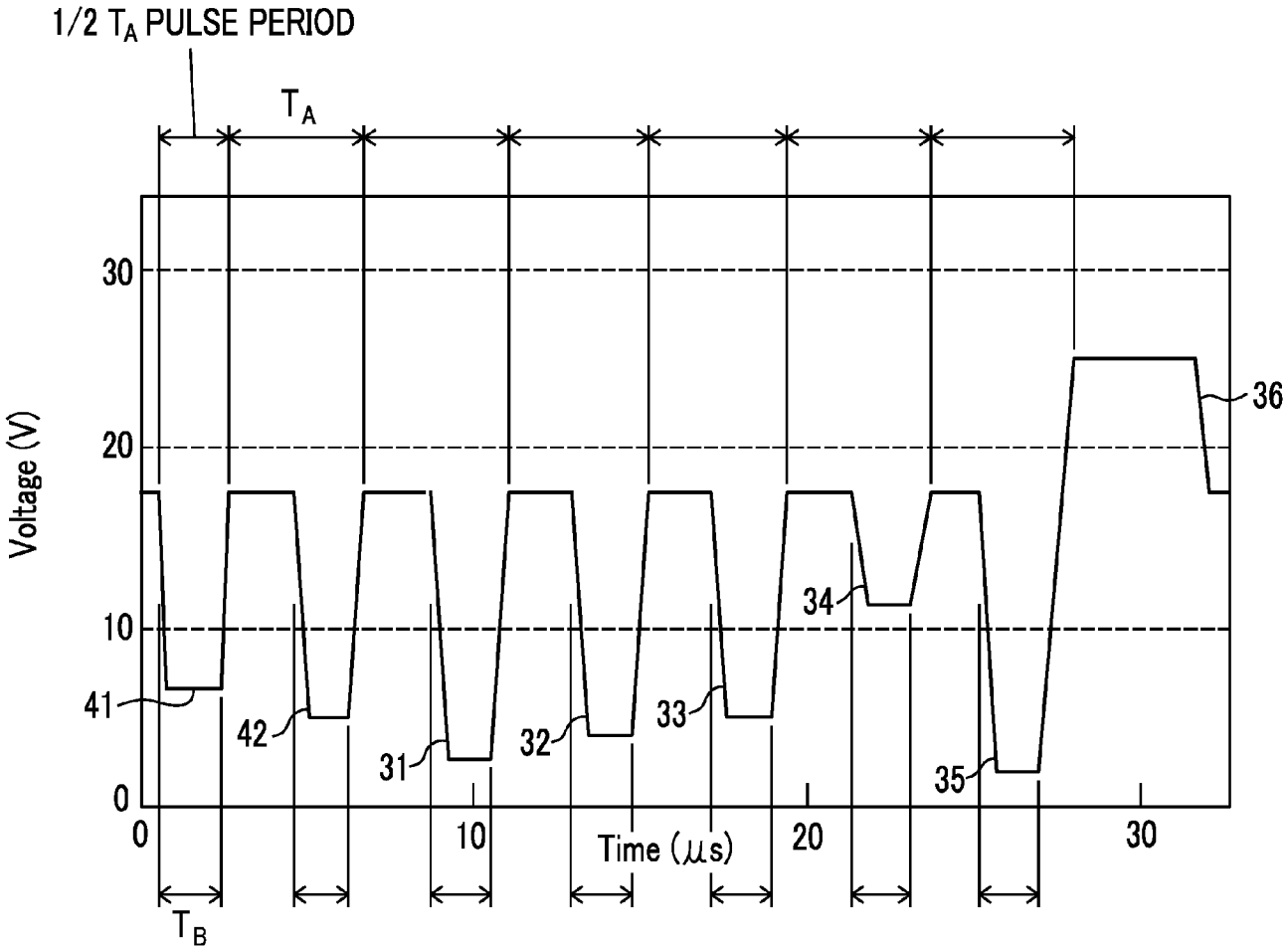
FIG. 12 is a waveform diagram that illustrates a driving waveform used for discharging a large droplet.

FIG. 12 is a detailed diagram of FIG. 11C. In the waveform of the large droplet, which is illustrated in FIG. 12, two pulses (41 and 42) are added to the former stage of the medium droplet. The voltage values of the additional first pulse 41 and the additional second pulse 42 that are added are adjusted such that the wave heights are lower than the first medium pulse (third pulse) denoted by reference numeral 31, and the wave height gradually increase in the order of the additional first pulse 41->the additional second pulse 42->the third pulse 31.

In the case of the medium droplet, while the voltage amplitude of the successive pulse is gradually decreased from the leading pulse 31 except for the final pulse 35, in the case of the large droplet, a configuration is employed in which the voltage amplitude is gradually increased so as to increase the droplet speed in a portion from the leading pulse (the additional first pulse 41) to the third pulse.

The reason for this is as follows. In the large droplet, in a case where the voltage amplitudes of the additional first pulse 41 and the additional second pulse 42 are set to a value larger than that of the third pulse 31, and voltage adjustment for gradually decreasing the wave height value of each pulse in a range from the additional first pulse 41 to the third pulse 31 is employed, the first discharge and the second discharge are performed more stronger than the third discharge. Accordingly, there are disadvantages of [1] raising the discharge speed of a preceding droplet too much, [2] increasing the amount of the droplet too much, [3] being incapable of integrating a liquid droplet for the final pulse, and the like. In the viewpoint of avoiding such disadvantages, a waveform as illustrated in FIG. 12 is employed.

In this embodiment, the waveform of the medium droplet is of significant concern in consideration of the use frequency, and the waveform is designed according to an embodiment of the present invention such that a desired amount of the droplet (for example, 5 picolitters) and a desired discharge speed, which are based on the design specifications, are realized in the waveform of the medium droplet.

For the large droplet, a configuration is employed in which the additional pulses 41 and 42 as illustrated in FIG. 12 are added to the former stage of the waveform of the medium droplet as a reference so as to acquire a target amount of the droplet (for example, 10 picolitters). By determining the waveform of the largest droplet by using the waveform (main waveform) of the medium droplet as a base, it is relatively simple to align the discharge speeds of the medium droplet and the largest droplet.

In the waveform of the large droplet illustrated in the figure, the pulse period $T_A$ of each one of the discharge pulses (41, 42, and 31 to 35) is constant, and the pulse width $T_B$ of each one of the discharge pulses (41, 42, and 31 to 35) is constant.

In addition, the waveform of the small droplet that is illustrated in FIG. 11A is included in the waveform (FIG. 11B) of the medium droplet and is acquired by selecting only the final pulse and the reverberation suppressing pulse from the waveform of the medium droplet. According to such a configuration, the droplet speeds (times until the droplets land on a recording medium) of the small droplet, the medium droplet, and the largest droplet can be aligned.

As illustrated with reference to FIGS. 11A to 11C and 12, there is the relationship in which waveform of the medium droplet includes the waveform of the small droplet, and the waveform of the large droplet includes the waveforms of the medium droplet and the small droplet. In other words, by sequentially selecting some pulses from the rear side of the waveform of the large droplet and applying the pulse to a piezoelectric element, the amount of the droplet (the type of droplet) can be changed.

In order to align the droplet speeds (discharge speeds) of all the droplet types on the whole and achieve a target amount of the droplet for each droplet type, a waveform of a droplet type (in this example, a medium droplet) that is central from the viewpoint of the use frequency or the like is generated by applying the present invention, and another pulse is added to the former stage of the main waveform for the droplet type of a droplet amount that exceeds that of the generated waveform. The added pulse, as described with reference to FIG. 12, is set such that the wave height gradually increases.

Expansion to Three or More Droplet Types

In the description presented above, although an example has been described in which droplets are divided into three types, the waveform can be determined by using a similar method even in a case where droplets are divided into three or more types. In other words, a droplet type other than a droplet type having the largest amount of the droplet or a droplet type having the smallest amount is selected as a main droplet type, the waveform (referred to as a "main waveform") corresponding to the main droplet type is determine from the above-described viewpoints.

At this time, the main waveform is configured so as to include the waveform of a droplet type of which the amount of the droplet is smaller than that of the main droplet. When a droplet type of which the amount of the droplet is larger than that of the main droplet type, another pulse is added to the former stage of the main waveform, and the wave height of the added pulse is lower than that of the leading pulse of the main waveform. It is preferable that the wave heights of the added pulses gradually increase from the first discharge. Accordingly, the waveforms of all the droplet types are determined. The waveform corresponding to the droplet type having the largest amount of the droplet includes the waveforms of all the droplet types.

In addition, the number of discharge pulses in the main waveform or the number of additional pulses added to the former stage of the main waveform is not particularly limited. By further adding M (here, M is an integer that is equal to or greater than one) discharge pulses to the former stage of the main waveform that includes N (here, N is an integer that is equal to or greater than three) in one recording period, a driving waveform corresponding to the discharge of the amount of the droplet that exceeds the amount of the droplet according to the main waveform can be acquired.

By selecting K (here, K is an integer that is equal to or greater than one and is equal to or less than M+N) from a driving waveform that includes M+N discharge pulses in one recording period from the rear side thereof and supplying the selected discharge pulses to a discharge energy generating element, discharge having a different amount of the droplet can be performed.

In a case where such a driving waveform is applied to an actual ink jet apparatus, basic waveform data (waveform data corresponding to the droplet type having the largest amount of the droplet) including the waveforms of all the droplet types is built in a storage unit such as a memory, and delimiter information that represents a pulse to be a leasing pulse at the time of being applied is maintained for each droplet type. By selecting pulses from the basic waveform (the waveform having the largest amount of the droplet) that is configured by a plurality of pulses including the waveforms of all the droplet types from the rear side thereof, the droplet types can be divided.

For example, by controlling a switching element that is placed in a signal delivery line that is used for applying a driving signal to the discharge energy generating element, a discharge pulse that is applied in accordance with the droplet type is selected. Accordingly, by using the switching element placed in correspondence with each discharge energy generating element, a driving voltage of the waveform corresponding to each droplet type is applied to the piezoelectric element.

Other Example of Driving Waveform

Although examples have been described with reference to FIGS. 1, 4, 8, and 9 in which the target amount of the droplet and the droplet speed are realized by adjusting the voltage amplitude of each pulse, by not only adjusting the voltage amplitude but also adjusting the pulse interval, the pulse width, and the slope of the pulse in a combinational manner, a target amount of the droplet and the target droplet speed can be realized.

Figure 13:
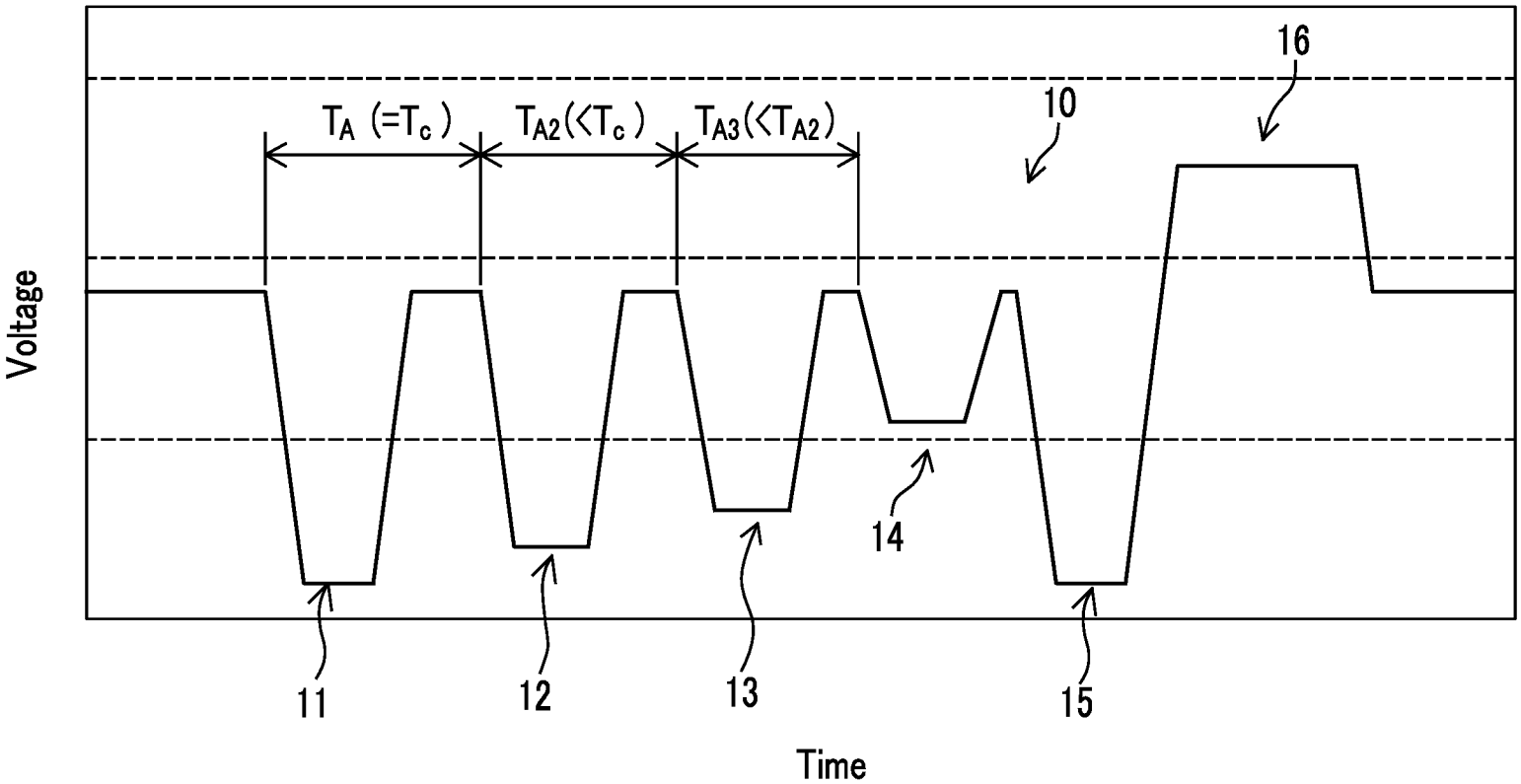
FIG. 13 is a waveform diagram that illustrates an example of a driving waveform that is adjusted by combining a voltage amplitude and a pulse interval.
Figure 14:
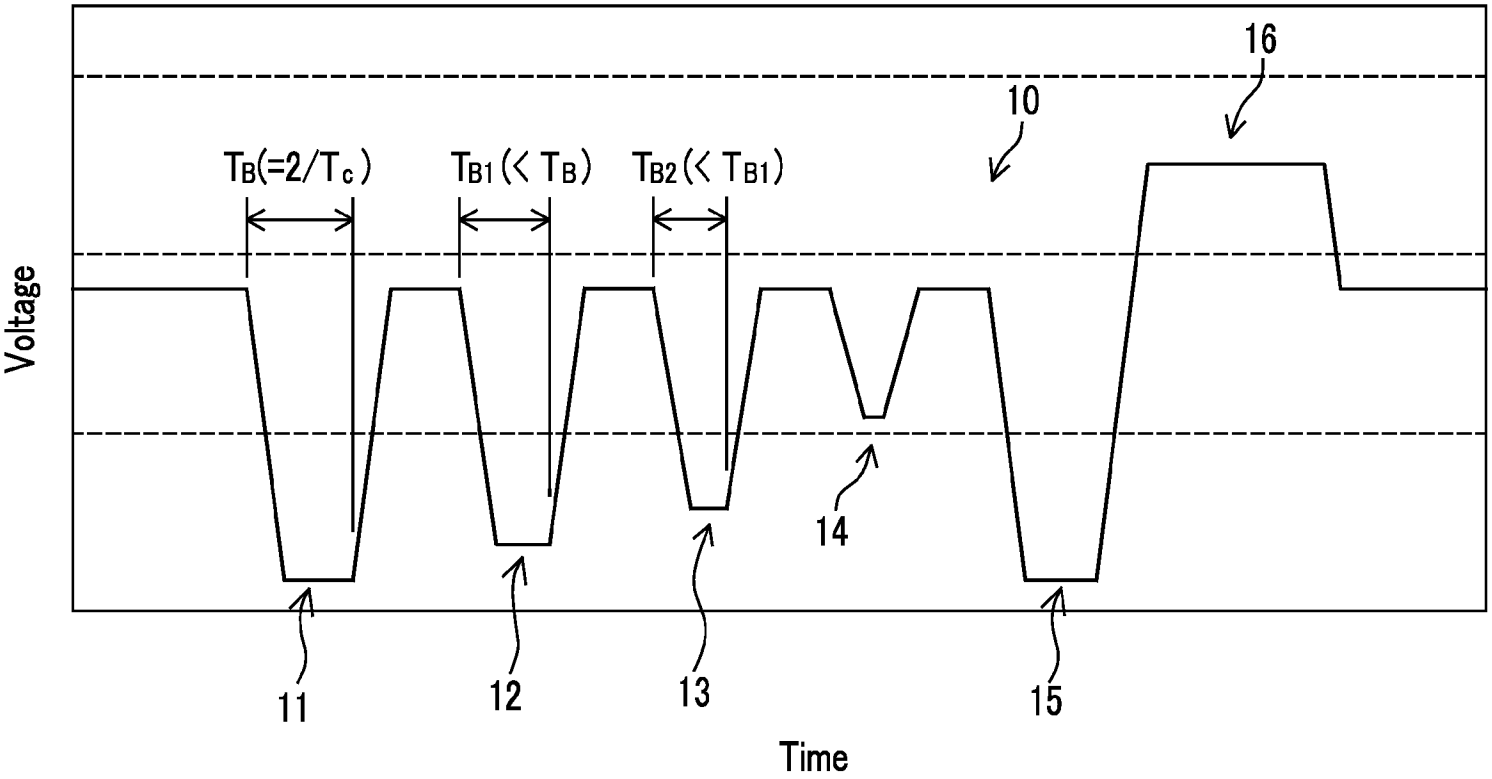
FIG. 14 is a waveform diagram that illustrates an example of a driving waveform that is adjusted by combining a voltage amplitude and a pulse width.
Figure 15:
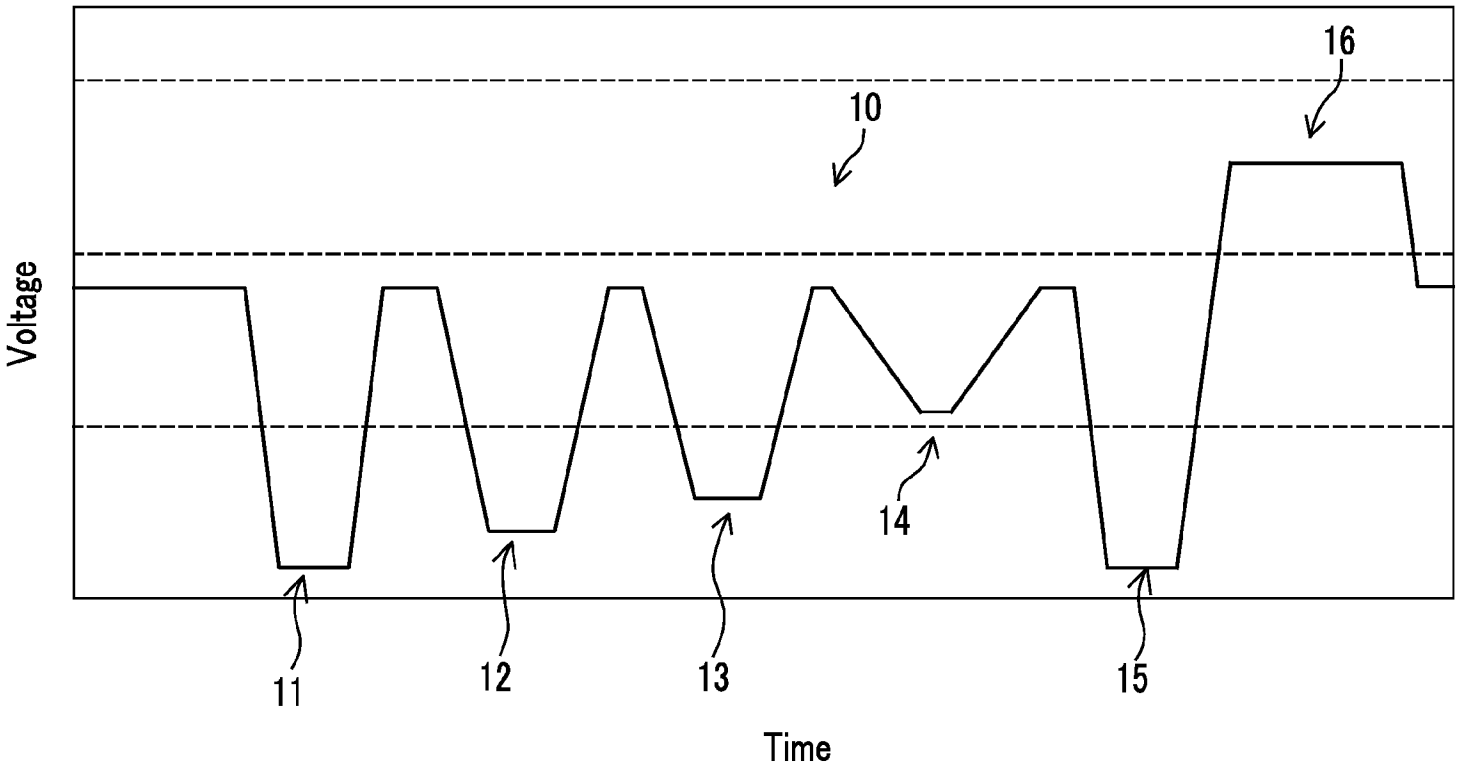
FIG. 15 is a waveform diagram that illustrates an example of a driving waveform that is adjusted by combining a voltage amplitude and the inclination of the slope of a pulse.

FIGS. 13 to 15 illustrate modified examples of the driving waveform described with reference to FIG. 1. The driving waveform illustrated in FIG. 13 is an example of the waveform in which the adjustment of the voltage amplitude of each pulse described with reference to FIG. 1 and the adjustment of the pulse interval $T_A$ are combined.

In FIG. 13, by gradually shifting the pulse interval $T_A$ of the successive pulse from the resonant period Tc within the remaining pulse train 11 to 14 acquired by excluding the final pulse 15, the discharge energy is configured to be weakened.

The pulse interval $T_A$ may be shifted in the direction increasing the pulse interval $T_A$ with respect to the resonant period Tc, or the pulse interval $T_A$ may be shifted in the direction shortening (decreasing) the pulse interval $T_A$ with respect to the resonant period Tc. The range of the shift of the value is not particularly limited.

In the example illustrated in FIG. 13, the pulse interval $T_A$ between the leading pulse 11 and the second pulse 12 is the resonant period Tc, the pulse interval $T_{A2}$ between the second pulse 12 and the third pulse 13 is shorter than the resonant period Tc, and the pulse interval $T_{A3}$ between the third pulse 13 and the fourth pulse 14 is shorter than the pulse interval $T_{A2}$ between the second pulse 12 and the third pulse 13.

The driving waveform illustrated in FIG. 14 is an example of the waveform in which the adjustment of the voltage amplitude of each pulse 11 to 14, which has been described with reference to FIG. 1, and the adjustment of the pulse width $T_B$ is combined. FIG. 14 illustrates a configuration in which the discharge energy is weakened by gradually shifting the pulse width $T_B$ of the successive pulse from a half of the resonant period Tc within the remaining pulse train (11 to 14) acquired by excluding the final pulse 15. The pulse width of the successive pulse may be shifted in a direction increasing the pulse width of the successive pulse with respect to the leading pulse width or may be shifted in a direction shortening (decreasing) the pulse width of the successive pulse. The range of the shift of the value is not particularly limited.

In the example illustrated in FIG. 14, the pulse width $T_B$ of the leading pulse 11 is a half of the resonant period Tc, the pulse width $T_{B2}$ of the second pulse 12 is shorter than a half of the resonant period Tc, and the pulse width A3 of the third pulse 13 is shorter than the pulse interval $T_{B2}$ of the second pulse 12.

The driving waveform illustrated in FIG. 15 is an example of the waveform in which the adjustment of the voltage amplitude of each pulse (11 to 14) described with reference to FIG. 1 and the adjustment of the inclination of the slope of the successive pulse. FIG. 15 illustrates a configuration in which the discharge energy is weakened by gradually decreasing the inclination of the slope of the successive pulse within the remaining pulse train (11 to 14) acquired by excluding the final pulse 15.

According to the configuration example described with reference to FIGS. 13 to 15, the implementation of a low voltage that is lower than that of the configuration illustrated in FIG. 1 can be performed. In addition, a configuration acquired by appropriately combining the forms illustrated in FIGS. 12 to 15 can be employed. In other words, by appropriately combining the adjustment of the voltage amplitude and the adjustment of the pulse interval, the pulse width, the inclination of the slop, or the like, a driving waveform that realizes a target amount of the droplet and a target droplet speed can be further easily designed.

Disclosure of Related Driving Waveform

Figure 16:
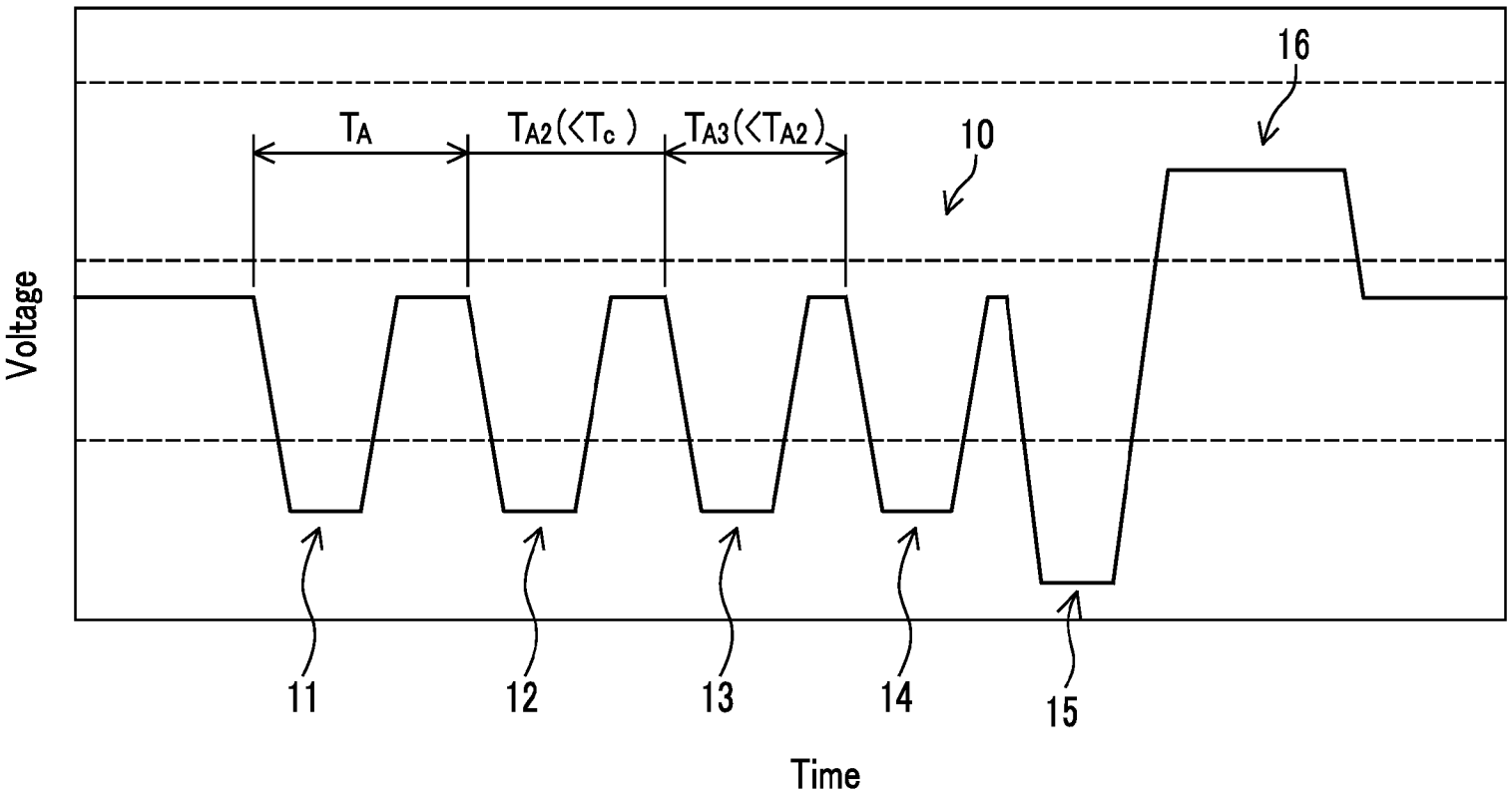
FIG. 16 is a waveform diagram that illustrates an example of a continuous discharge pulse waveform of which discharge energy is gradually weakened by adjusting a pulse interval.
Figure 17:
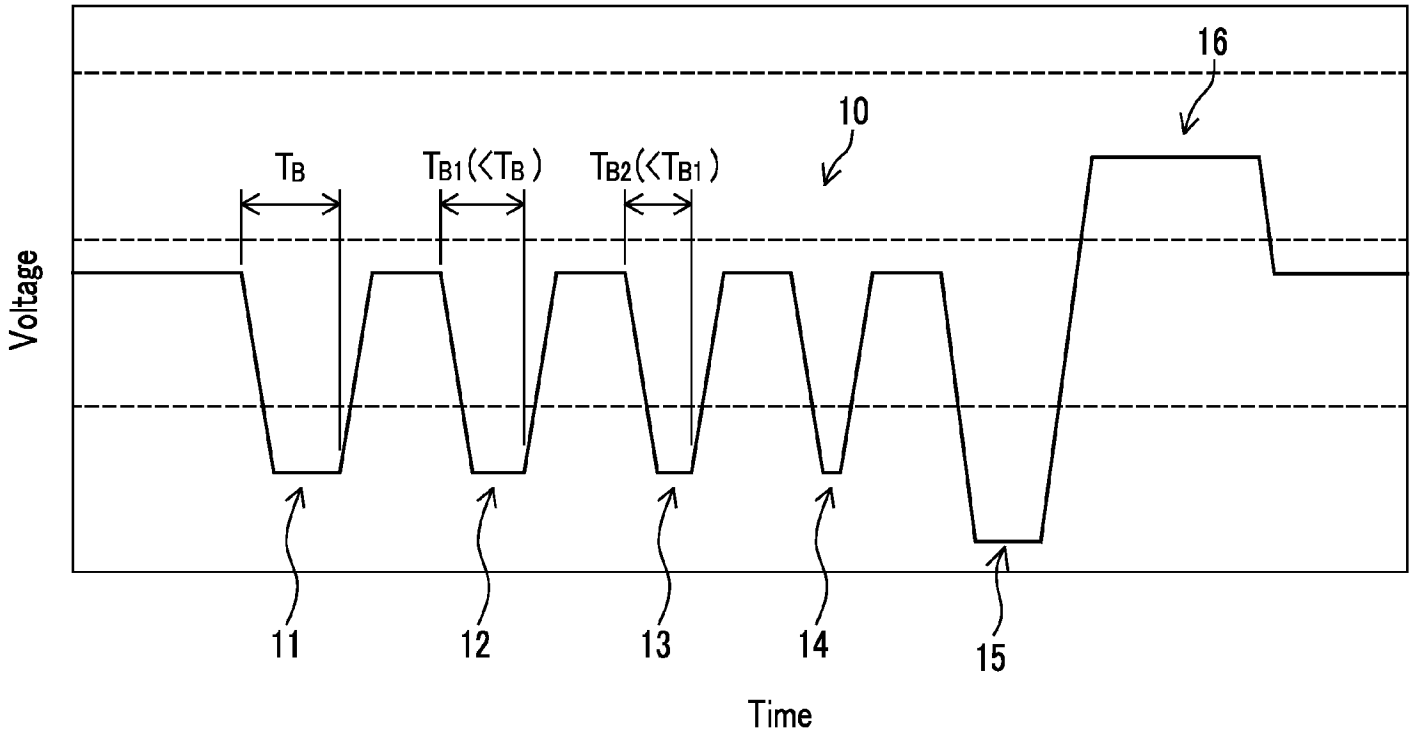
FIG. 17 is a waveform diagram that illustrates an example of a continuous discharge pulse waveform of which discharge energy is gradually weakened by adjusting a pulse width.
Figure 18:
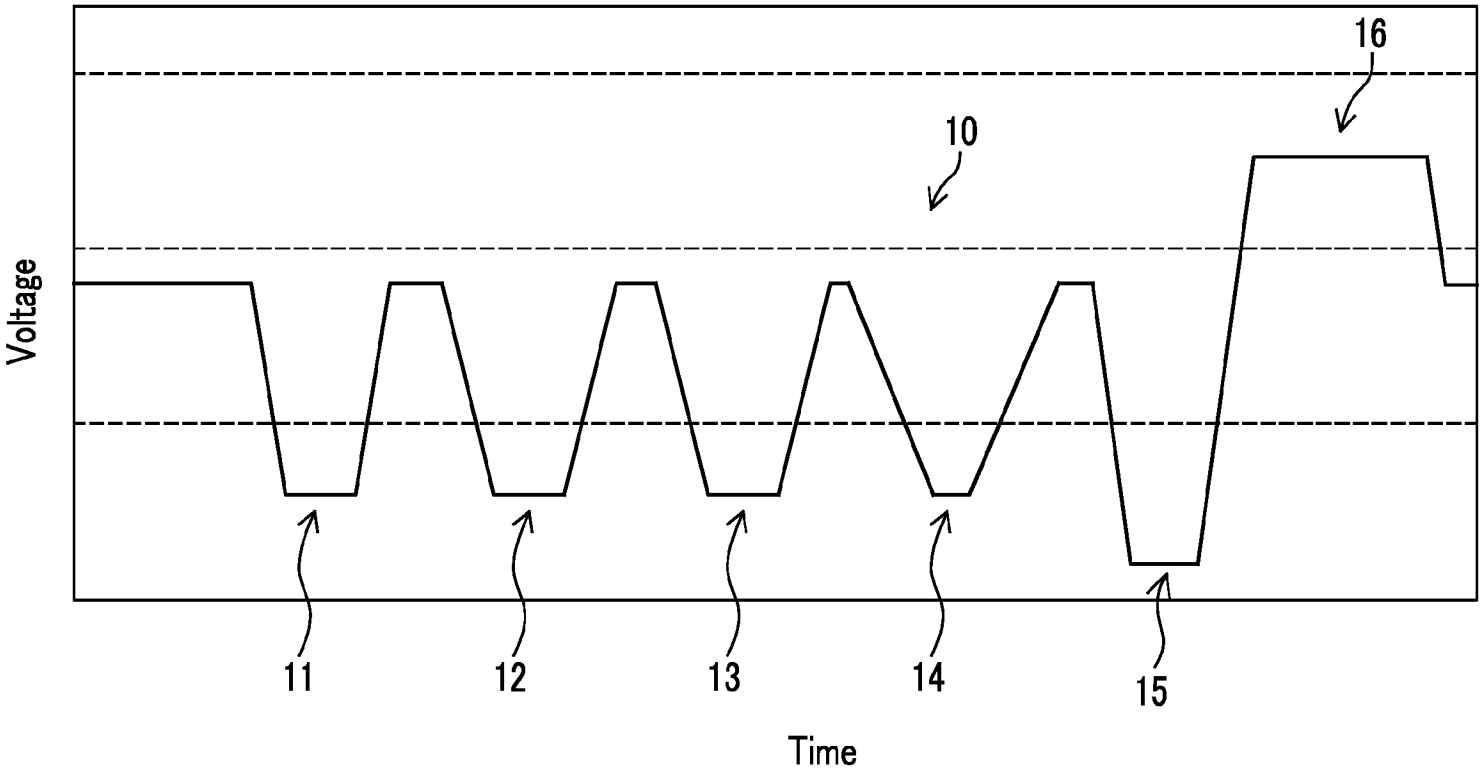
FIG. 18 is a waveform diagram that illustrates an example of a continuous discharge pulse waveform of which discharge energy is gradually weakened by adjusting the inclination of the slope of a pulse.

Relating to the driving waveforms illustrated in FIGS. 13 to 15 as examples, driving waveforms illustrated in FIGS. 16 to 18 will be disclosed.

FIGS. 16 to 18 illustrates the driving waveform in which the adjustment of the voltage amplitude of the pulses (11 to 14) described with reference to FIG. 1 is not used, and the discharge energy of the successive pulse is weakened through the adjustment of the pulse interval $T_A$, the adjustment of the pulse width $T_B$, or the adjustment of the inclination of the slope of the pulse.

In FIG. 16, by gradually shifting the pulse interval $T_A$ of the successive pulse from the resonant period Tc within the remaining pulse train acquired by excluding the final pulse, the discharge energy is configured to be weakened.

In FIG. 17, by gradually shifting the pulse width $T_B$ of the successive pulse from a half of the resonant period Tc within the remaining pulse train acquired by excluding the final pulse, the discharge energy is configured to be weakened.

In FIG. 18, by gradually decreasing the inclination of the slope of the successive pulse within the remaining pulse train acquired by excluding the final pulse, the discharge energy is configured to be weakened.

By using the waveforms described with reference to FIGS. 16 to 18 or an appropriate combination thereof, a target amount of the droplet and a target droplet speed can be realized. However, in consideration of lengthening the lifetime in accordance with the implementation of a low voltage, the forms described with reference to FIGS. 1, 4, 8, and 9 are preferable.

Configuration Example of Ink Jet Recording Apparatus (Driving Device for Liquid Discharging Head)

Figure 19:
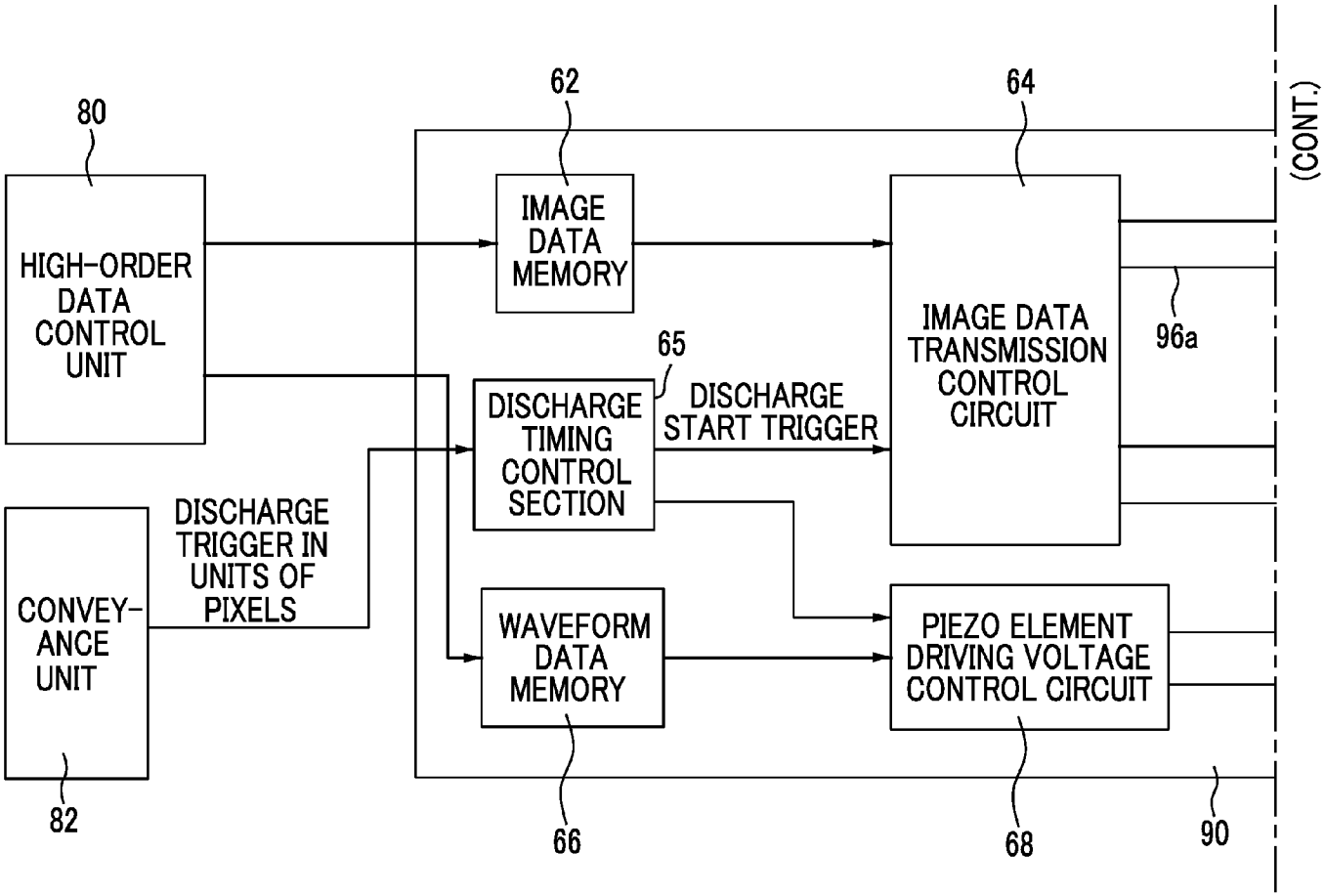
FIG. 19 is a block diagram that illustrates an example of the configuration of an ink jet recording apparatus, to which a driving device for a liquid discharging head according to an embodiment of the present invention is applied.

FIG. 19 is a block diagram that illustrates an example of the configuration of an ink jet recording apparatus, to which a driving device for a liquid discharging head according to an embodiment of the present invention is applied.

A print head (corresponding to a "liquid discharging head") 50 is configured by combining a plurality of ink jet head modules (hereinafter, referred to as "head modules") 52*a* and 52*b*.

Here, for the simplification of the description, although two head modules 52*a* and 52*b* are illustrated in the figure, the number of head modules that configured one print head 50 is not particularly limited.

Although a detailed configuration of the head modules 52*a* and 52*b* are not illustrated in the figure, a plurality of nozzles (ink discharging ports) is two-dimensionally arranged with a high density on the ink discharging face of each one of the head modules 52*a* and 52*b*. In addition, in the head modules 52*a* and 52*b*, a discharge energy generating element (in the case of this example, a piezoelectric element) corresponding to each nozzle is disposed.

In the widthwise direction of a sheet (not illustrated in the figure) as a drawing target medium, by connecting the plurality of head modules 52*a* and 52*b* together, a line head (a page-wide head capable of single path printing), which has a nozzle row that can draw dots for the whole recordable range (the entire area in the width in which drawing can be performed) in the direction of the sheet width with predetermined recording resolution (for example 1200 dpi), having a long length is configured.

A head control unit 60 (corresponding to a "driving device for a liquid discharging head") that is connected to the print head 50 controls the driving of piezoelectric elements corresponding to the nozzles of the plurality of head modules 52*a* and 52*b* and serves as a control unit that is used for controlling an operation of discharging ink (discharge/non-discharge and the amount of the discharged liquid droplet) from the nozzles.

The head control unit 60 is configured to include: an image data memory 62; an image data transmission control circuit 64; a discharge timing control section 65; a waveform data memory 66; a driving voltage control circuit (piezo element driving voltage control circuit) 68; and D/A converters 79*a* and 79*b*. In addition, in this example, the image data transmission control circuit 64 includes a "latch signal transmitting circuit", and a data latch signal is output to each one of the head modules 52*a* and 52*b* from the image data transmission control circuit 64 at appropriately timing.

In the image data memory 62, image data that is expanded into printing image data (dot data) is stored. In the waveform data memory 66, digital data that represents the voltage waveform (driving waveform) of a driving signal that is used for operating the piezoelectric element is stored. For example, data of the driving waveform and data representing the delimiter of pulses, which have been described with reference to FIGS. 11A to 11C, and the like are stored in the waveform data memory 66. The image data input to the image data memory 62 and the waveform data input to the waveform data memory 66 are managed by a higher-order data control unit 80 (corresponding to a "higher-order control device").

The higher-order data control unit 80, for example, can be configured by a PC or a host computer. The head control unit 60 includes a USB (Universal Serial Bus) as a data communication unit that is used for receiving data from the higher-order data control unit 80 and other communication interfaces.

In FIG. 19, for the simplification of the description, although only one print head 50 (corresponding to one color) is represented, in the case of an ink jet recording apparatus that includes a plurality of print heads (for colors) corresponding to the colors of ink of a plurality of colors, the head control unit 60 is individually (in units of heads) disposed for the print head 50 of each color.

For example, in a configuration that includes print heads of each color corresponding to four colors including cyan (C), magenta (M), yellow (Y), and black (K), the head control unit 60 is disposed for the print head of each color of CMYK, and a configuration is employed in which the head control units of the colors are managed by one higher-order data control unit 80.

At the time of starting up the system, waveform data or image data is transmitted to the head control unit 60 of each color from the higher-order data control unit 80. In addition, the image data may be transmitted in synchronization with a sheet conveying operation at the time of printing.

When a printing operation is performed, the discharge timing control section 65 of each color receive a discharge trigger signal transmitted from the sheet conveying unit 82 and outputs a start trigger for starting a discharge operation to the image data transmission control circuit 64 and the driving voltage control circuit 68.

The image data transmission control circuit 64 and the driving voltage control circuit 68 performs a selective discharge operation (drop on-demand discharge driving control) in accordance with the image data by receiving the start trigger and transmitting the waveform data and the image data in units corresponding to the resolution from the image data transmission control circuit 64 and the driving voltage control circuit 68 to the head modules 52*a* and 52*b*, thereby realizing page-wide printing.

By outputting the driving voltage waveform data from the driving voltage control circuit 68 to the D/A converters 79*a* and 79*b* in accordance with a print timing signal (discharge trigger signal) that is input from the outside, the waveform data is converted into analog voltage waveforms by the D/A converters 79*a* and 79*b*.

The output waveforms (analog voltage waveforms) of the D/A converters 79*a* and 79*b* are amplified to predetermined currents or voltages that are appropriate for driving the piezoelectric element by an amplifier circuit (power amplifier circuit) not illustrated in the figure and then are supplied to the head modules 52*a* and 52*b*.

The image data transmission control circuit 64 can be configured by a CPU (Central Processing Unit), an FPGA (Field Programmable Gate Array). The image data transmission control circuit 64 controls the transmission of nozzle control data (here, image data corresponding to the dot arrangement of recording resolution) of the head modules 52*a* and 52*b* to the head modules 52*a* and 52*b* based on data stored in the image data memory 62.

The nozzle control data is image data (dot data) that is used for determining On (discharge driving)/Off (non-driving) of nozzles. The image data transmission control circuit 64 transmits the nozzle control data to the head modules 52*a* and 52*b*, thereby controlling the opening/closing (On/Off) of each nozzle.

Image data transmitting paths 92*a* and 92*b* that are used for transmitting the nozzle control data output from the image data transmission control circuit 64 to the head modules 52*a* and 52*b* are called "image data buses", "data buses", "image buses", or the like and are configured by a plurality of (n) signal lines (here, n≥2). In this embodiment, hereinafter, the image data transmitting paths will be referred to as "data buses" 92*a* and 92*b*.

One end of each one of the data buses 92*a* and 92*b* is connected to the output terminal (IC pin) of the image data transmission control circuit 64, and the other end thereof is connected to the head module 52*a* or 52*b* through a connector 94*a* or 94*b* corresponding to each one of the head modules 52*a* and 52*b*.

The data buses 92*a* and 92*b* may be configured by copper line patterns of an electric circuit board 90 on which the image data transmission control circuit 64, the driving voltage control circuit 68, and the like are mounted, may be configured in a wireless harness, or may be configured by a combination thereof.

In addition, signal lines 96*a* and 96*b* of data latch signals corresponding to the head modules 52*a* and 52*b* are disposed for each head modules 52*a* and 52*b*. In order to set the data signals transmitted through the data buses 92*a* and 92*b* as nozzle data of the head modules 52*a* and 52*b*, the data latch signals are transmitted from the image data transmission control circuit 64 to the head modules 52*a* and 52*b* at required timing.

At a time point at which a predetermined amount of image data is transmitted from the image data transmission control circuit 64 to the head modules 52*a* and 52*b* through the image data buses 92*a* and 92*b*, a signal (latch signal) called a data latch is transmitted to the head modules 52*a* and 52*b*. At the timing of the data latch signal, On/Off data for the displacement of the piezoelectric element of each module is determined at the timing of the data latch signal.

Thereafter, by applying driving voltages a and b to the head modules 52*a* and 52*b*, the piezoelectric element relating to the setting On is slightly displaced so as to discharge ink droplets. By attaching (landing) the ink droplets discharged in such a way to a sheet, printing with desired resolution (for example, 1200 dpi) is performed. In addition, the piezoelectric element that is set to Off is not displaced even in a case where a driving voltage is applied thereto, whereby a liquid droplet is not discharged.

A combination of the waveform data memory 66, the driving voltage control circuit 68, the D/A converters 79*a* and 79*b*, and switching elements (not illustrated in the figure) used for switching between the operation/non-operation of the piezoelectric element corresponding to each nozzle corresponds to a "driving signal generating unit".

Description of Another Configuration Example of Ink Jet Recording Apparatus

Whole Configuration

Figure 20:
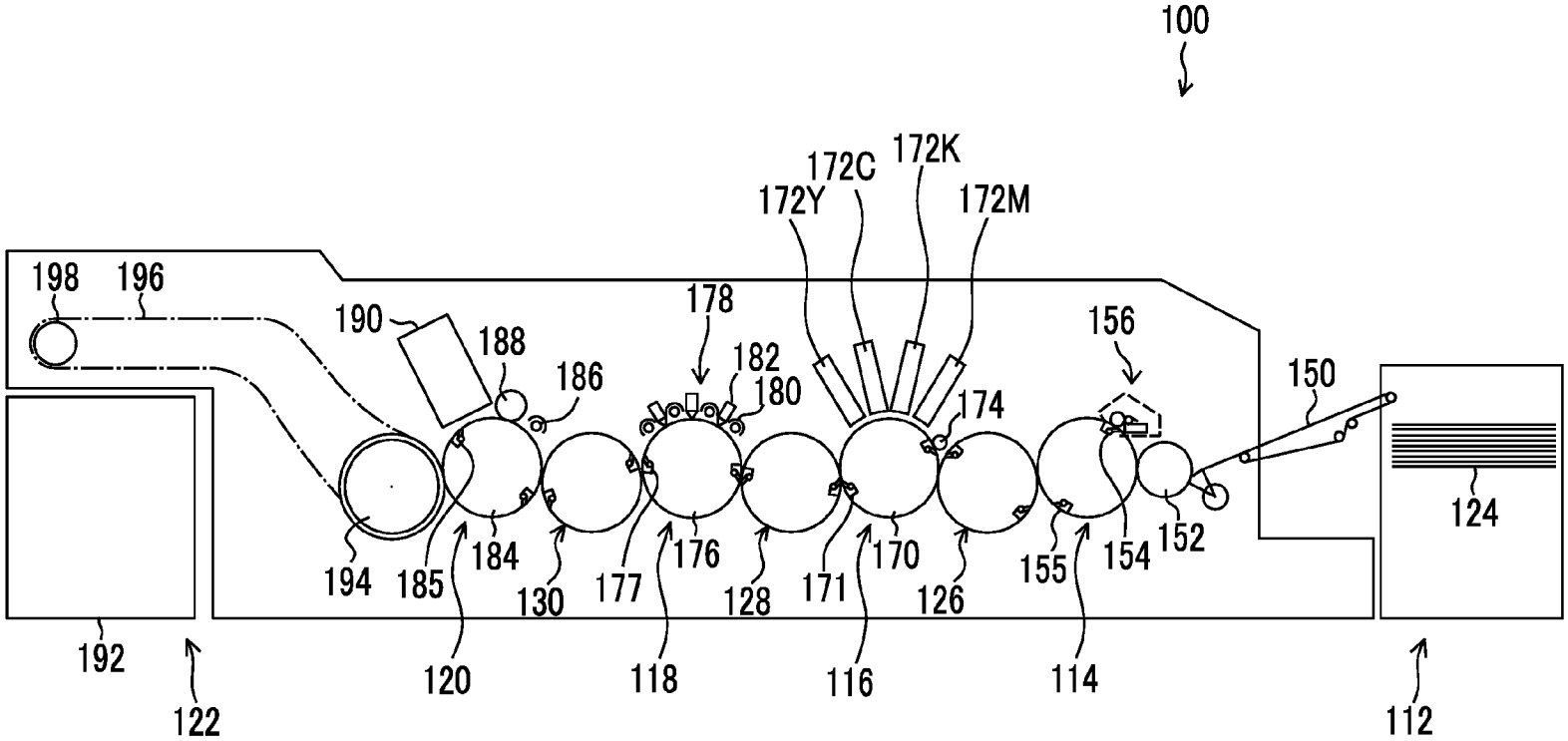
FIG. 20 is a diagram that illustrates the whole configuration of an ink jet recording apparatus according to an embodiment of the present invention.

FIG. 20 is a whole configuration diagram that illustrates another configuration example of an ink jet recording apparatus according to an embodiment of the present invention. The ink jet recording apparatus 100 of this example is mainly configured by a sheet feeding unit 112, a process liquid supplying unit (pre-coating unit) 114, a drawing unit 116, a drying unit 118, a fixing unit 120, and a sheet discharging unit 122.

The ink jet recording apparatus 100 is an ink jet recording apparatus of a single path type that forms a desired color image by hitting a recording medium 124 (it corresponds to a "drawing target medium" and hereinafter, for the convenience of the description, may be referred to as a "sheet") that is maintained on a drum (drawing drum 170) of the drawing unit 116 with ink of a plurality of colors from ink jet heads 172M, 172K, 172C, and 172Y and is a drop on-demand type image forming apparatus to which a two-liquid reaction (cohesion) method is applied in which process liquid (here, cohesion process liquid) is supplied to the recording medium 124 before ink droplet hitting, and an image is formed on the recording medium 124 through an action between the process liquid and ink liquid.

Sheet Feeding Unit

In the sheet feeding unit 112, recording media 124 as sheets of paper are stacked, and one recording medium 124 is fed each time from a sheet feeding tray 150 of the sheet feeding unit 112 to the process liquid supplying unit 114. In this example, although sheets of paper (cut sheets) are used as the recording media 124, a configuration may be employed in which a required size is cut from continuous paper (roll paper), and the cut part is fed.

Process Liquid Supplying Unit

The process liquid supplying unit 114 is a mechanism that supplies process liquid to a recoding face of the recording medium 124. The process liquid contains a coloring material flocculating agent that flocculates a coloring material (in this example, a pigment) contained in the ink that is provided from the drawing unit 116, and, by bringing the process liquid and the ink into contact with each other, separation between the coloring material and a solvent is promoted.

The process liquid supplying unit 114 includes a sheet feeding cylinder 152, a process liquid drum (also referred to as a "pre-coating body") 154, and a process liquid coating device 156. The process liquid drum 154 is a drum that maintains the recording medium 124 and rotates and conveys the recording medium.

The process liquid drum 154 includes a claw-shaped holding unit (gripper) 155 on the outer circumferential face and, by interposing the recording medium 124 between the claw of the holding unit 155 and the circumferential face of the process liquid drum 154, the front end of the recoding medium 124 can be held.

On the outer circumferential face of the process liquid drum 154, suction holes may be arranged, and a suction unit that performs suction through the suction holes may be connected to the process liquid drum 154. In such a case, the recording medium 124 can be maintained on the circumferential face of the process liquid drum 154 in an air-tight manner.

The process liquid coating device 156 is configured by a process liquid container in which the process liquid is stored, an anilox roller (measuring roller) that is partially soaked in the process liquid contained in the process liquid container, and a rubber roller that is brought into tight contact with the anilox roller and the recording medium 124 disposed on the process liquid drum 154 and transfers the process liquid after the measurement to the recording medium 124.

In this embodiment, although a configuration has been illustrated as an example to which a roller coating type is applied, the present invention is not limited thereto, and, any type such as a spray type or an ink jet method can be applied thereto.

The recording medium 124 to which the process liquid is supplied by the process liquid supplying unit 114 is delivered from the process liquid drum 154 to the drawing drum 170 of the drawing unit 116 through an intermediate conveyance unit 126.

Drawing Unit

The drawing unit 116 includes a drawing drum (also called a "drawing body" or a "jetting body") 170, a sheet suppressing roller 174, and ink jet heads 172M, 172K, 172C, and 172Y. As the ink jet heads 172M, 172K, 172C, and 172Y of each color and a control device thereof, the configuration of the print head 50 described with reference to FIG. 24 and the configuration of the head control unit 60 are employed.

The drawing drum 170, similarly to a process liquid drum 154, includes a claw-shaped holding unit (gripper) 171 on the circumferential face thereof. On the circumferential face of the drawing drum 170, a plurality of suction holes, which are not illustrated in the figure, is formed in a predetermined pattern. Thus, as the air is sucked from the suction holes, the recording medium 124 is adsorbed to the circumferential face of the drawing drum 170 so as to be maintained.

In addition, the present invention is not limited to the configuration in which the recording medium 124 is sucked and adsorbed through negative pressure suction, and, for example, a configuration may be employed in which the recording medium 124 is sucked and maintained through electrostatic adsorption.

The ink jet heads 172M, 172K, 172C, and 172Y are ink jet-type recording heads of a full line type that has a length corresponding to a maximum width of an image forming area of the recording medium 124. On the ink discharging face, a nozzle array (two-dimensionally arranged nozzles) is formed in which a plurality of ink discharging nozzles is arranged over the entire width of the image forming area. The ink jet heads 172M, 172K, 172C, and 172Y are placed so as to extend in a direction perpendicular to the conveying direction (the rotation direction of the drawing drum 170) of the recording medium 124.

To the ink jet heads 172M, 172K, 172C, 172Y, cassettes (ink cartridges) of ink of corresponding colors are installed. Ink droplets are discharged from the ink jet heads 172M, 172K, 172C, 172Y toward a recording face of the recording medium 124 that is maintained on the outer circumferential face of the drawing drum 170.

Accordingly, ink is brought into contact with the process liquid that is supplied to the recording face in advance, and a coloring material (pigment) that disperses in the ink coheres so as to form a coloring material aggregate. As an example of the reaction between the ink and the process liquid, in this embodiment, the blurring of the coloring material, a mixed color that occurs due to mixing of ink of colors, and the interference with other droplet hitting through liquid integration at the time of landing of the ink droplets are avoided by using a mechanism in which acid is added into the process liquid, and the pigment dispersion is destroyed so as to cohere by lowering the PH. Accordingly, the flow of the coloring material on the recording medium 124 and the like are prevented, and an image is formed on the recording face of the recording medium 124.

The droplet hitting timing of the ink jet heads 172M, 172K, 172C, and 172Y is synchronized with an encoder (not illustrated in FIG. 19; reference numeral 294 in FIG. 23) that is arranged in the drawing drum 170 and detects the rotation speed. A discharge trigger signal (pixel trigger) is generated based on a detection signal acquired by the encoder. Accordingly, the landing position can be determined with high accuracy.

In addition, the unevenness droplet hitting can be reduced without depending on the deviation of the drawing drum 170, the accuracy of the rotation shaft, the speed of the outer circumferential face of the drawing drum 170 by learning speed variations of the drawing drum 170 due to the deviation or the like in advance and correcting the droplet hitting timing that is acquired by the encoder. In addition, maintenance operations such as an operation of cleaning the nozzle face of the ink jet heads 172M, 172K, 172C, and 172Y and an operation of discharging ink of which the viscosity has increased may be performed by retreating the head unit from the drawing drum 170.

In this example, although a configuration of standard colors (four colors) CMYK has been described as an example, a combination of the colors of ink and the number of colors is not limited to that of this embodiment, and thus, light shade ink, dark ink, and special-color ink may be added as is necessary. For example, a configuration may be employed in which ink jet heads that discharge light ink such as light cyan and light magenta are added, and the arrangement order of the color heads is not particularly limited.

The recording medium 124 on which an image is formed by the drawing unit 116 is delivered from the drawing drum 170 to a drying drum 176 of the drying unit 118 through an intermediate conveyance unit 128.

Drying Unit

The drying unit 118 is a mechanism that dries moisture contained in the solvent that is separated by a coloring material cohering action and includes a drying drum (also called a "drying body") 176 and a solvent drying device 178. The drying drum 176, similarly to the process liquid drum 154, includes a claw-shaped holding unit (gripper) 177 on the outer circumferential face thereof, and the front end of the recording medium 124 can be held by the holding unit 177.

The solvent drying device 178 is arranged at a position facing the outer circumferential face of the drying drum 176 and is configured by a plurality of halogen heaters 180 and hot-air jetting nozzles 182 that are arranged between the halogen heaters 180. By appropriately adjusting the temperature and the flow rate of hot air that is blown from each hot-air jetting nozzle 182 toward the recording medium 124 and the temperature of each halogen heater 180, various drying conditions can be realized. The recording medium 124 for which a drying process has been performed by the drying unit 118 is delivered from the drying drum 176 to a fixing drum 184 of the fixing unit 120 through an intermediate conveyance unit 130.

Fixing Unit

Fixing Unit 120 is configured by a fixing drum (also called a "fixing body") 184, a halogen heater 186, a fixing roller 188, and an in-line sensor 190. The fixing drum 184, similarly to the process liquid drum 154, includes a claw-shaped holding unit (gripper) 185 on the outer circumference face thereof, and the front end of the recording medium 124 can be held by the holding unit 185.

The recording medium 124 is conveyed with the recording face facing the outer side in accordance with the rotation of the fixing drum 184, and, for the recording face, preliminary heating is performed by the halogen heater 186, a fixing process is performed by the fixing roller 188, and a test is performed by the in-line sensor 190.

The fixing roller 188 is a roller member that is used for coating ink by welding self-dispersible polymer microparticles by heating and compressing the dried ink and is configured so as to heat and compress the recording medium 124. The recording medium 124 is interposed between the fixing roller 188 and the fixing drum 184 and is nipped with predetermined nip pressure (for example, 0.15 MPa), thereby performing a fixing process.

In addition, the fixing roller 188 is configured by a heating roller that is acquired by building a halogen lamp into a metal pipe made of aluminum or the like that has high thermal conductivity and is controlled to be at a predetermined temperature (for example, 60 to 80° C.). By heating the recording medium 124 by using the heating roller, heat energy that is equal to or higher than Tg temperature (glass transition point temperature) of latex that is included in the ink is given so as to melt latex particles. Accordingly, push-in fixing is performed at the unevenness of the recording medium 124, and the unevenness of the image surface is leveled so as to acquire glossiness.

The in-line sensor 190 is a reading unit that is used for measuring a discharge defect checking pattern, the density of an image, a defect of an image, or the like in an image (including a test pattern or the like) recorded on the recording medium 124, and a CCD line sensor or the like is used.

According to the fixing unit 120 that is configured as above, the latex particles placed inside a thin image layer formed by the drying unit 118 are heated and compressed by the fixing roller 188 so as to be melt, whereby the image can be fixed to the recording medium 124.

Here, instead of ink that includes a high-boiling point solvent and polymer microparticles (thermoplastic resin particles), a monomer component that can be polymerized and cured through exposure to ultraviolet rays (UV) may be contained. In such a case, the ink jet recording apparatus 100 includes an UV exposure unit that exposes ink disposed on the recording medium 124 to UV rays, instead of a heating/compressing fixing unit (fixing roller 188) using a heating roller.

As above, in a case where ink that contains an active ray curable resin such as a UV curable resin is used, instead of the fixing roller 188 for heated fixing, a unit that emits active rays such as a UV lamp or an ultraviolet LD (laser diode) array is disposed.

Sheet Discharging Unit

After the fixing unit 120, the sheet discharging unit 122 is disposed. The sheet discharging unit 122 includes a discharge tray 192, and between the discharge tray 192 and the fixing drum 184 of the fixing unit 120, a delivery body 194, a conveyance belt 196, and a stretching roller 198 are disposed so as to face them.

The recording medium 124 is sent to the conveyance belt 196 by the delivery body 194 and is discharged to the discharge tray 192. Although a sheet conveying mechanism by means of the conveyance belt 196 is not illustrated in detail in the figure, the sheet front end portion of the recording medium 124 after printing is held by a gripper of a bar (not illustrated in the figure) delivered between endless conveyance belts 196, and the recording medium 124 is carried to the upper side of the discharge tray 192 in accordance with the conveyance belt 196.

In addition, although not illustrated in FIG. 20, in addition to the above-described configuration, the ink jet recording apparatus 100 of this example includes: an ink storing/charging unit that supplies ink to the ink jet heads 172M, 172K, 172C, and 172Y; a unit that supplies the process liquid to the process liquid supplying unit 114; a head maintenance unit that performs a cleaning operation (nozzle face wiping, purging, nozzle suction, and the like) of the ink jet heads 172M, 172K, 172C, and 172Y; a position detecting sensor that detects the position of the recording medium 124 on the sheet conveying path; a temperature sensor that detects the temperature of each unit of the apparatus; and the like.

Configuration Example of Ink Jet Head

Next, the structure of the ink jet head will be described. Since the structure of each one of the ink jet heads 172M, 172K, 172C, and 172Y is common, hereinafter, the head will be denoted by reference numeral 250, representing these.

Figure 21A:
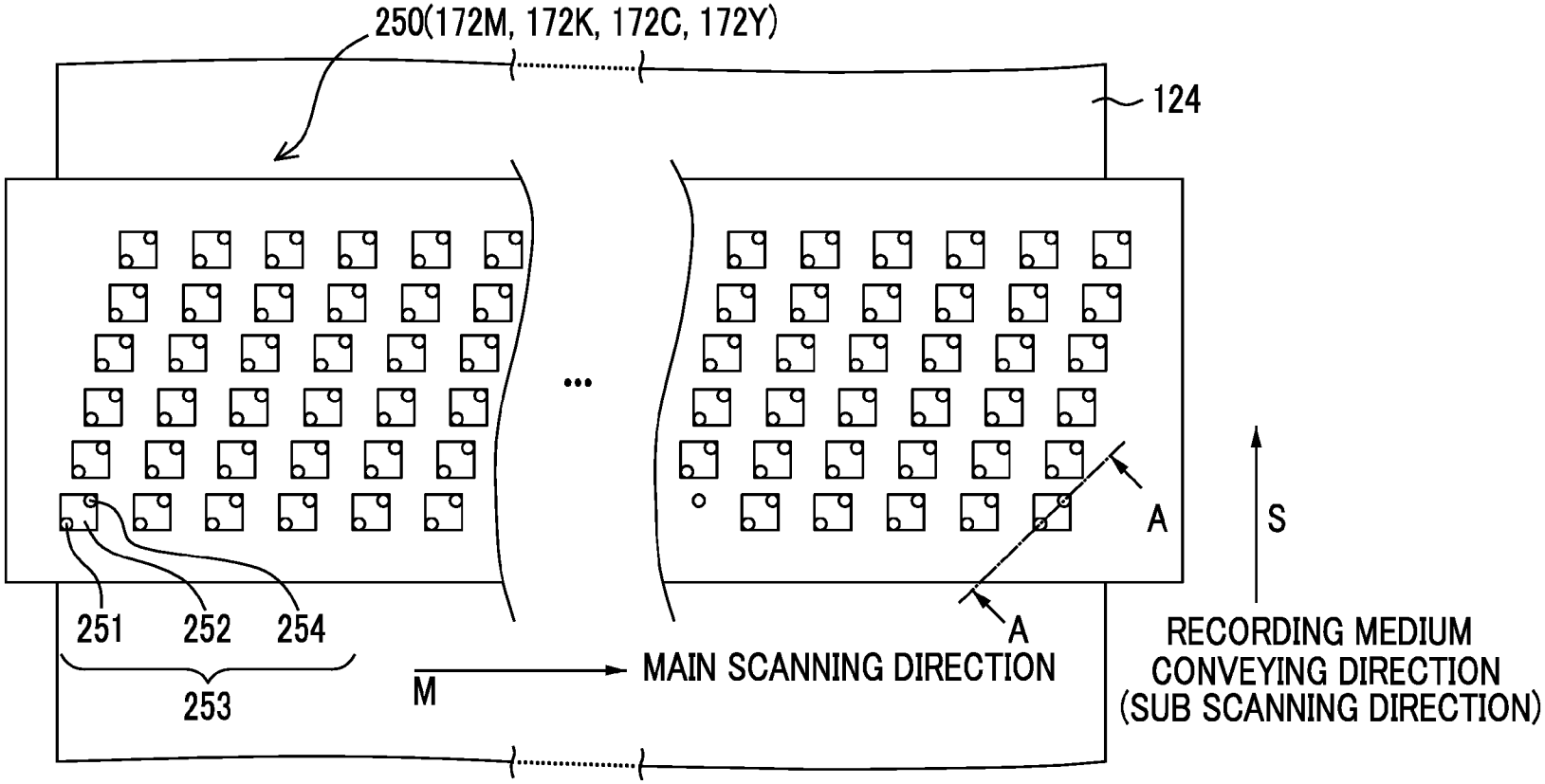
FIGS. 21A and 21B are planar perspective views that illustrate an example of the configuration of an ink jet head.
Figure 21B:
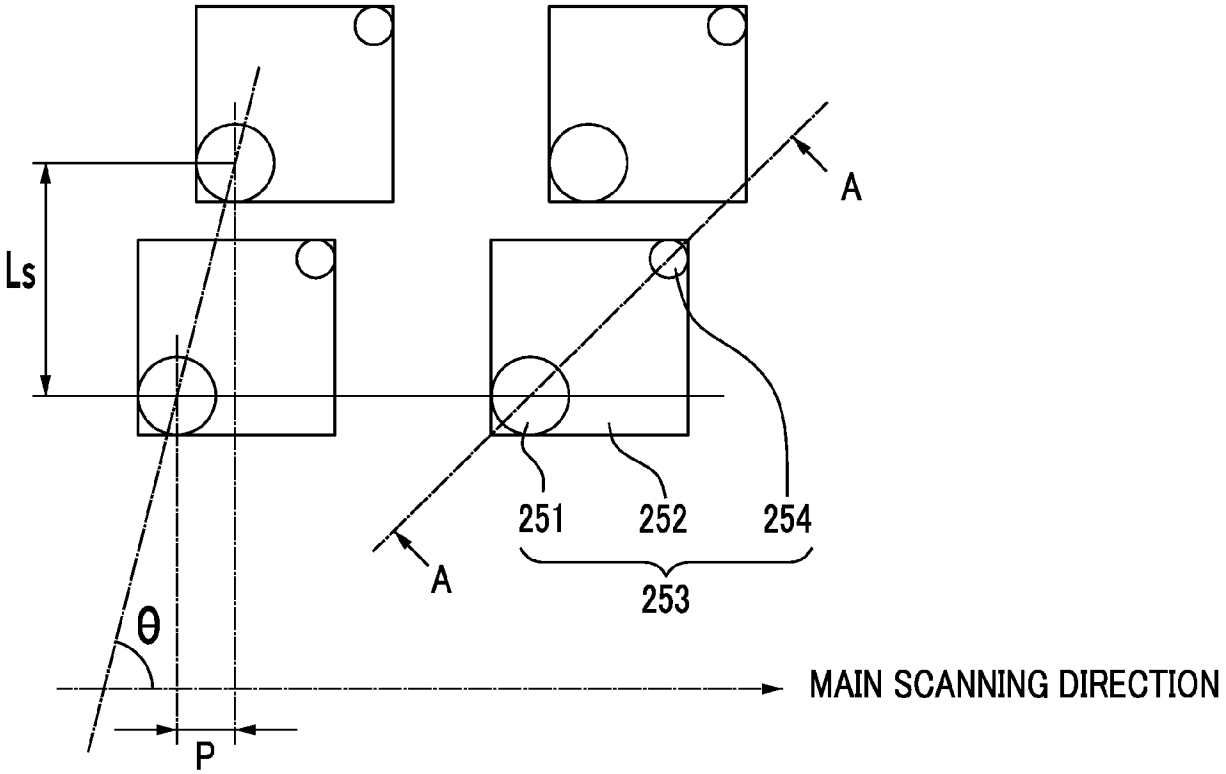
Figure 22A:
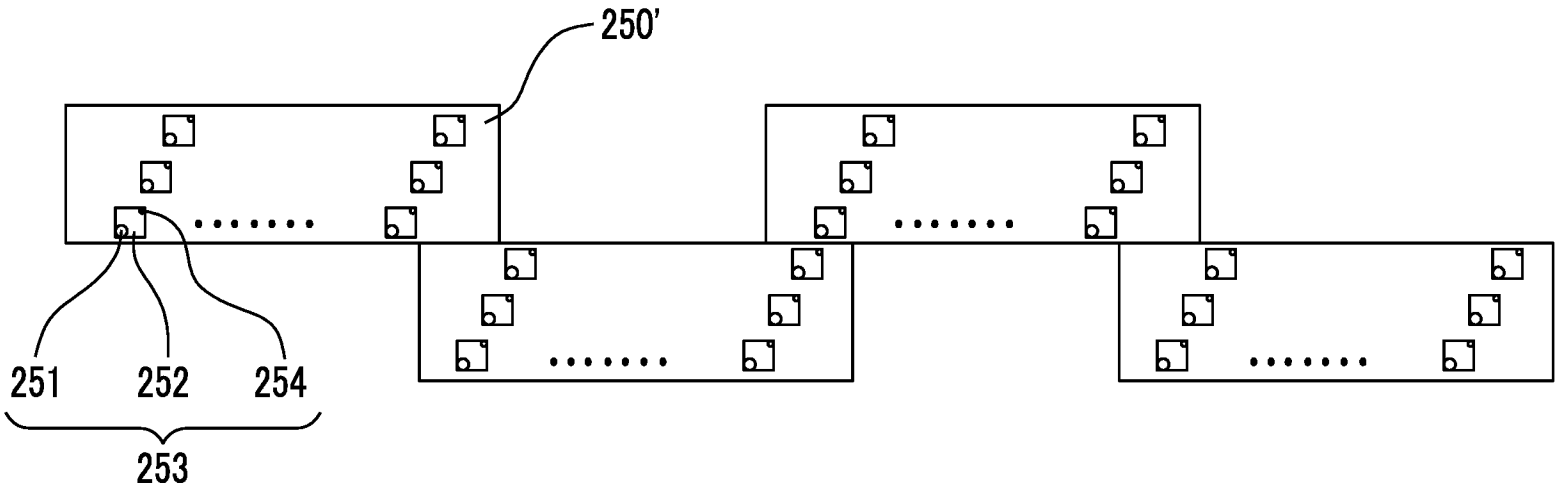
FIGS. 22A and 22B are planar perspective views that illustrate other examples of the head.
Figure 22B:
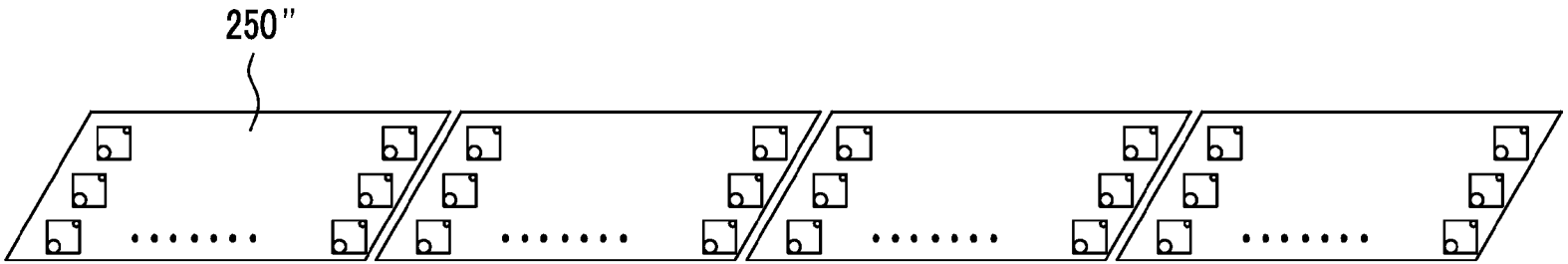

FIG. 21A is a planar perspective view that illustrates an example of the structure of the head 250, and FIG. 21B is an enlarged view of a part thereof. FIGS. 22A and 22B are diagrams that illustrate examples of the arrangement of a plurality of head modules configuring the head 250.

Figure 23:
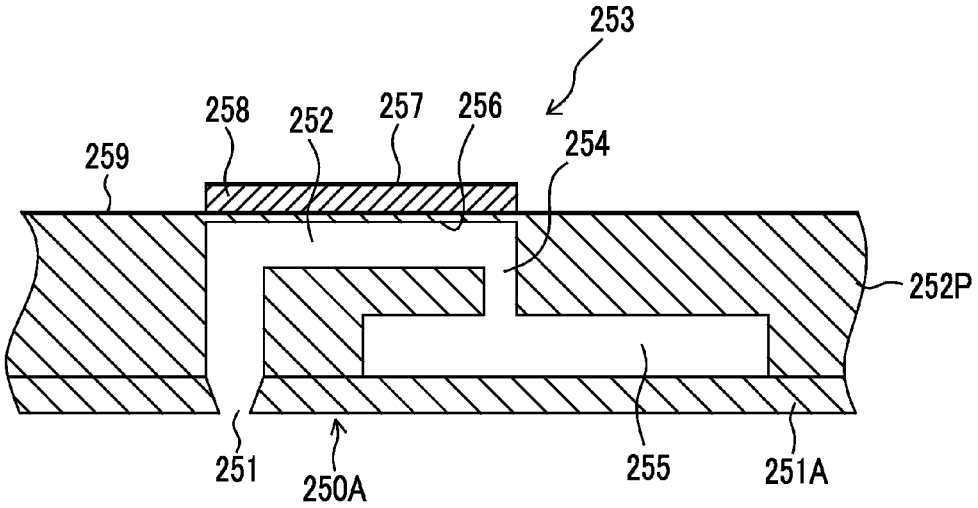
FIG. 23 is a cross-sectional view taken along line A-A shown in FIGS. 21A and 21B.

FIG. 23 is a cross-sectional view (cross-sectional view taken along line A-A shown in FIGS. 21A and 21B) that illustrates a three-dimensional configuration of a liquid droplet discharging element (an ink chamber unit corresponding to one nozzle 251) corresponding to one channel as a recording element unit (discharging element unit).

As illustrated in FIGS. 21A and 21B, the head 250 of this example has a structure in which a plurality of ink chamber units (liquid droplet discharging elements) 253 each configured by a nozzle 251 as an ink discharging port, a pressure chamber 252 corresponding to each nozzle 251, and the like is two-dimensionally arranged in a matrix pattern. Accordingly, implementation of a high density of the substantial nozzle interval (projected nozzle pitch) that is projected (orthogonally projected) so as to be aligned along the head length direction (a direction perpendicular to the sheet conveying direction) is achieved.

In order to configure a nozzle array having a length corresponding to the entire width $W_m$ of the drawing area of the recording medium 124 or more in a direction (the direction of arrow M; it corresponds to a "second direction") approximately perpendicular to the direction (the direction of arrow S; it corresponds to a "first direction") sending the recording medium 124, for example, as illustrated in FIG. 22A, head modules 250A having a short length in which a plurality of the nozzles 251 is two-dimensionally arranged are arranged in a zigzag pattern so as to configure a line-type head having a long length.

Alternatively or additionally, as illustrated in FIG. 22B, a form may be employed in which head modules 250B are aligned so as to be connected together in one row. The head module 250A or 250B illustrated in FIG. 22A or 22B corresponds to the head module 52*a* or 52*b* described with reference to FIG. 19.

In addition, a full-line type print head for single-path printing is not limited to a case where the entire face of the recording medium 124 is set as the drawing range, and, in a case where a part of the face of the recording medium 124 is set as the drawing area (for example, a case where a non-drawing area (a margin portion) is arranged on the periphery of a sheet or the like), a nozzle row that is required for drawing within a predetermined drawing area may be formed.

The planar shape of the pressure chamber 252 that is disposed in correspondence with each nozzle 251 is an approximate rectangle (see FIGS. 21A and 21B), and, on one of both diagonal corners of the pressure chamber 252, an outlet to the nozzle 251 is disposed, and, on the other corner, an inlet (supply port) 254 of supplied ink is disposed. Here, the shape of the pressure chamber 252 is not limited to this example, and thus, there may be various planar shapes thereof such as a rectangle (a rhombus, a rectangle, or the like), a pentagon, a hexagon, and any other polygon, a circle, an oval, and the like.

As illustrated in FIG. 23, the head 250 (the head modules 250A and 250B) is formed from a structure in which a nozzle plate 251A, on which the nozzle 251 is formed, a flow-path plate 252P, on which the pressure chamber 252 and a flow path such as a common flow path 255 are formed, are stacked and bonded together.

The nozzle plate 251A configures the nozzle face (ink discharging face) 250A of the head 250, and a plurality of nozzles 251 that communicate with the pressure chambers 252 are two-dimensionally formed.

The flow-path plate 252P is a flow path forming member that configures a side wall portion of the pressure chamber 252 and forms a supply port 254 as a throttle portion (narrowest portion) for individual supply paths that guide ink from the common flow path 255 to the pressure chamber 252. For the convenience of the description, although the flow-path plate 252P is simplified in FIGS. 22A and 22B, it has a structure of one substrate or a structure in which a plurality of substrates is stacked.

The nozzle plate 251A and the flow-path plate 252P can be processed into required shapes through a semiconductor manufacturing process using silicon as a material.

The common flow path 255 communicates with an ink tank (not illustrated in the figure) as an ink supply source, and ink that is supplied from the ink tank is supplied to each pressure chamber 252 through the common flow path 255.

To a vibration plate 256 that configures a part of faces (the upper face in FIG. 23) of the pressure chamber 252, a piezo actuator (piezoelectric element) 258 having an individual electrode 257 is bonded. The vibration plate 256 of this example is formed from silicon (Si) to which a nickel (Ni) conductive layer serving as a common electrode 259 corresponding to a lower electrode of the piezo actuator 258 is added and also serves as a common electrode of the piezo actuators 258 that are arranged in correspondence with the pressure chambers 252.

In addition, a form in which the vibration plate is formed from a non-conductive material such as a resin may be employed. In such a case, a common electrode layer formed from a conductive material such as metal is formed on the surface of a vibration plate member. In addition, a vibration plate that also serves as the common electrode may be formed from metal (conductive material) such as stainless steel (SUS).

By applying a driving voltage to the individual electrode 257, the piezo actuator 258 is transformed so as to change the volume of the pressure chamber 252, and ink is discharged from the nozzle 251 due to a pressure change accompanied with the change in the volume. When the piezo actuator 258 is returned to its original state after discharge of the ink, new ink is refilled in the pressure chamber 252 from the common flow path 255 through the supply port 254.

By arranging a plurality of the ink chamber units 253 having such a structure, as illustrated in FIG. 21B, in a row direction along the main scanning direction and a row direction having an inclination of a predetermined angle θ that is not perpendicular to the main scanning direction in a predetermined arrangement pattern in a lattice shape, a high-density nozzle head of this example is realized. In such a matrix arrangement, when the nozzle interval between adjacent nozzles in the sub scanning direction is $L_s$, it can be handled equivalently with a case where the nozzles 251 are substantially arranged at a predetermined pitch $P=L_s/\tan\theta$) in a linear shape in the main scanning direction.

In performing the present invention, the arrangement form of the nozzles 251 in the head 250 is not limited to the example illustrated in the figure, but various nozzle arrangement structures can be employed. For example, instead of the matrix arrangement described with reference to FIG. 20, a V-shaped nozzle arrangement, a broken-line shaped nozzle arrangement in which the V-shaped arrangement is set as a repetition unit such as a zigzag pattern (W-shaped or the like), or the like may be employed.

In addition, the unit that is used for generating discharge pressure (discharge energy) used for discharging liquid droplets from the nozzles of the ink jet head is not limited to the piezo actuator (piezoelectric element). Thus, various pressure generating element (discharge energy generating element) such as an electrostatic actuator, a heater (heating element) used in a thermal type (a type in which ink is discharged by using film boiling pressure caused by heating a heater), and various types of actuators of other types can be used. An energy generating element corresponding to the discharge type of the head is disposed in a flow path structure body.

Description of Control System

Figure 24:
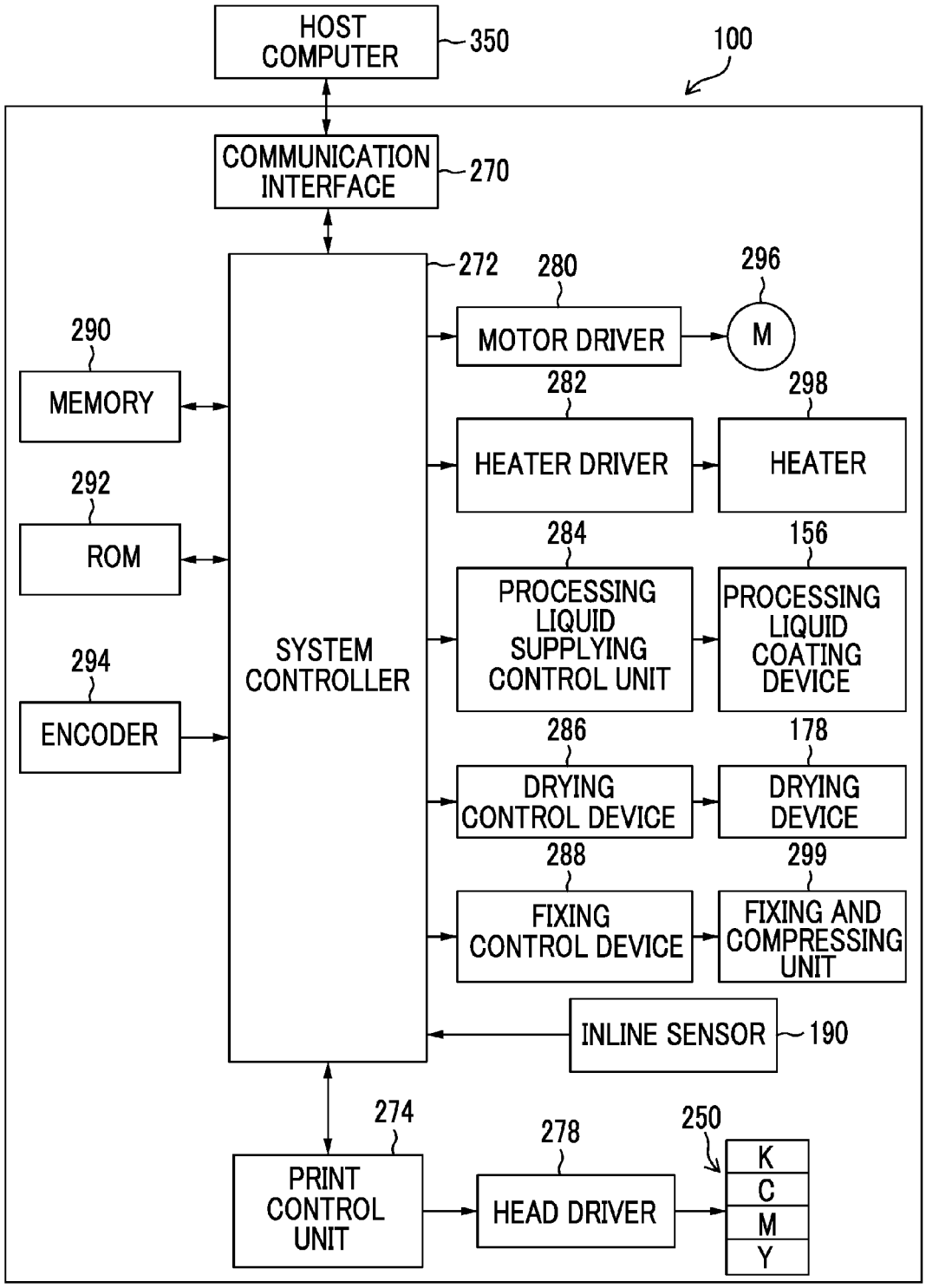
FIG. 24 is a block diagram of a main portion that illustrates the system configuration of an ink jet recording apparatus.

FIG. 24 is a block diagram of a main portion that illustrates the system configuration of the ink jet recording apparatus 100. The ink jet recording apparatus 100 includes a communication interface 270, a system controller 272, a print control unit 274, an image buffer memory 276, a head driver 278, a motor driver 280, a heater driver 282, a process liquid supplying control unit 284, a drying control unit 286, a fixing control unit 288, a memory 290, a ROM 292, an encoder 294, and the like.

The communication interface 270 is an interface unit that receives image data transmitted from a host computer 350.

As the communication interface 270, a serial interface such as a USB (Universal Serial Bus), IEEE 1394, Ethernet (registered trademark), or a wireless network or a parallel interface such as Centronics can be used. In this part, a buffer memory (not illustrated in the figure) that is used for increasing the communication speed may be installed.

Image data transmitted from the host computer 350 is received by the ink jet recording apparatus 100 through the communication interface 270 and is temporarily stored in the memory 290.

The memory 290 is a storage unit that temporarily stores an image that is input through the communication interface 270 and performs data reading and data writing through the system controller 272. The memory 290 is not limited to a memory that is formed from a semiconductor element, and a magnetic medium such as a hard disk may be used.

The system controller 272 is configured by a central processing unit (CPU), peripheral circuits thereof, and the like, serves as a control device that controls the overall operation of the ink jet recording apparatus 100 in accordance with a predetermined program, and serves as a calculation device that performs various calculations.

In other words, the system controller 272 controls the units such as the communication interface 270, the print control unit 274, the motor driver 280, the heater driver 282, and the process liquid supplying control unit 284, controls communication with the host computer 350, controls reading and writing data from or into the memory 290, and generates control signals that are used for controlling a conveyance system motor 296 and a heater 298.

In the ROM 292, a program that is executed by the CPU of the system controller 272, various kinds of data required for a control operation, and the like are stored. The ROM 292 may be a storage unit that cannot be rewritten or a storage unit such as an EEPROM that can be overwritten. The memory 290 is used as a temporary storage area of the image data and is also used as a program expanding area and a calculation work area of the CPU.

The motor driver 280 is a driver that drives the motor 296 based on an instruction issued from the system controller 272. In FIG. 24, various motors arranged in the units within the apparatus are representatively denoted by reference numeral 296.

For example, in the motor 296 illustrated in FIG. 24, a motor that drives the rotation of the sheet feeding cylinder 152, the process liquid drum 154, the drawing drum 170, the drying drum 176, the fixing drum 184, the delivery body 194, and the like illustrated in FIG. 20, a driving motor of a pump that is used for negative-pressure sucking from the suction holes of the drawing drum 170, a motor of a retreating mechanism that moves the head units of the ink jet heads 172M, 172K, 172C, and 172Y to an maintenance area other than the drawing drum 170, and the like are included.

The heater driver 282 is a driver that drives the heater 298 based on an instruction issued from the system controller 272. In FIG. 23, various heaters arranged in each unit of the apparatus are representatively denoted by reference numeral 298. For example, in the heater 298 illustrated in FIG. 23, a preheater, which is not illustrated in the figure, used for heating the recording medium 124 up to an appropriate temperature in advance in the sheet feeding unit 112 and the like are included.

The print control unit 274 has a signal processing function of performing processes such as processing, correction, or the like used for generating a printing control signal from image data stored in the memory 290 under the control of the system controller 272 and is a control unit that supplies the generated printing data (dot data) to the head driver 278.

Generally, dot data is generated by performing a color converting process and a half-tone process for image data having multiple gray scale. The color converting process is a process that converts the image data (for example, 8-bit image data for each color of RGB) represented by sRGB or the like into color data (in this example, color data of KCMY) of each color of ink used by the ink jet recording apparatus 100.

The half-tone process is a process that converts the color data of each color generated through the color converting process into dot data of each color (in this example, dot data of KCMY) through a process such as an error diffusion method, a threshold value matrix, or the like.

In the print control unit 274, based on the dot data acquired by performing required signal processing, the amount of discharge or the discharge timing of the head 250 are controlled through the head driver 278. Accordingly, a desired dot size or a desired dot arrangement is realized. The dot data described here corresponds to "nozzle control data".

The print control unit 274 includes an image buffer memory (not illustrated in the figure), and, when the image data is processed by the print control unit 274, data such as image data or parameters are temporarily stored in the image buffer memory. In addition, by integrating the print control unit 274 and the system controller 272, one processor may be configured.

The flow of the process from an image input to a printing output will now be described. Data of an image to be printed is input from the outside through the communication interface 270 and is stored in the memory 290. In this step, for example, image data of RGB is stored in the memory 290.

In the ink jet recording apparatus 100, by changing the fine droplet hitting density or the dot size according to ink (coloring material), an image having consecutive gray scales that are similar to human eyes is formed, and accordingly, it is necessary to convert the data into a dot pattern that can be used for sufficiently reproducing the gray scale (shading of an image) of the input digital image as possibly as can.

Accordingly, the original image (RGB) data that is stored in the memory 290 is transmitted to the print control unit 274 through the system controller 272 and is converted into dot data for each ink color through a halftoning process using a threshold value matrix, an error diffusion method, or the like by the print control unit 274. In other words, the print control unit 274 performs a process of converting the input RGB data into dot data of four colors K, C, M and Y. The dot data generated by the print control unit 274 as above, is stored in the image buffer memory (not illustrated in the figure).

The head driver 278 outputs a driving signal used for driving the actuators corresponding to the nozzles of the head 250 based on the printing data (in other words, the dot data stored in the image buffer memory 276) given from the print control unit 274. The head driver 278 may include a feedback control system that is used for maintaining the driving condition of the head to be constant.

By applying the driving signal output from the head driver 278 to the head 250, ink is discharged from a corresponding nozzle. By controlling ink discharged from the head 250 while conveying the recording medium 124 at a predetermined speed, an image is formed on the recording medium 124.

In addition, the ink jet recording apparatus 100 illustrated in this example employs a driving system in which ink is discharged from the nozzle 251 corresponding to each piezo actuator 258 by switching between On/Off of the switching element (not illustrated in the figure) connected to the individual electrode of each piezoelectric actuator 258 in accordance with the discharge timing of each piezo actuator 258 by applying a common driving power waveform signal in units of modules to each piezo actuator 258 of the head 250 (head module).

The parts of the head driver 278 and the print control unit 274 (having the image buffer memory is built therein) correspond to the head control unit 60 described with reference to FIG. 24. In addition, the system controller 272 illustrated in FIG. 23 corresponds to the higher-order data control unit 80 described with reference to FIG. 24.

The process liquid supplying control unit 284 controls the operation of the process liquid coating device 156 (see FIG. 19) in accordance with an instruction issued from the system controller 272. The drying control unit 286 controls the operation of the solvent drying device 178 (see FIG. 20) in accordance with an instruction issued from the system controller 272.

The fixing control unit 288 controls the operation of the halogen heater 186 of the fixing unit 120 or the fixing and compressing unit 299 that is formed by the fixing roller 188 (see FIG. 19) in accordance with an instruction issued from the system controller 272.

The in-line sensor 190, as described with reference to FIG. 20, is a block that includes an image sensor, reads out an image printed on the recording medium 124, detects the printing state (discharge/non-discharge, a deviation of droplet hitting, an optical density, and the like) by performing required signal processing or the like, and provides the system controller 272 and the print control unit 274 with the detection result.

The print control unit 274 performs various corrections (non-discharge correction, density correction, and the like) for the head 250 based on information acquired from the in-line sensor 190 and controls a cleaning operation (nozzle recovery operation) such as preliminary discharge, suction, or wiping.

Modified Example of Apparatus

In the above-described embodiment, although the ink jet recording apparatus of a type (direct recording type) in which an image is formed by directly hitting ink droplets to the recording medium 124 has been described, the applicable range of the present invention is not limited thereto. In addition, the present invention can be applied also to an image forming apparatus of an intermediate transfer type in which an image (primary image) is formed on the intermediate transfer unit once and a final image is formed by transferring the image to the recording sheet.

In addition, in the above-described embodiment, although the ink jet recording apparatus (an image forming apparatus of the single path type that completes an image through one sub scanning) using a page-wide full-line type head having a nozzle array of which the length corresponds to the whole width of the recording medium has been described, however, the applicable range of the present invention is not limited thereto. Thus, the present invention can be applied to an ink-jet recording apparatus that performs image recording through a plurality of head scanning operations while moving the recording head having a short length such as a serial type (shuttle scanning type).

Unit That Relatively Moves Head and Sheet

In the above-described embodiment, although a configuration has been described as an example in which the recording medium is conveyed to a stopped head, in performing the present invention, a configuration may be employed in which the head is moved to the recording medium (drawing target medium).

Recording Medium

The "recording medium" is a general name of a medium on which a dot is recorded by liquid droplets discharged from the ink jet head and includes media that are called as various terms such as a printing medium, a recording target medium, an image forming target medium, an image reception medium, and a discharge target medium.

In performing the present invention, the material, the shape, and the like of the recording medium are not particularly limited. Thus, the present invention can be applied to various media such as continuous paper, a cut sheet, a sealing sheet, a resin sheet including an OHP sheet, a film, a cloth, non-woven fabrics, a printed board in which a wiring, a pattern, or the like is formed, a rubber sheet, or the like regardless of the material or the shape.

Application Example of Present Invention

In the above-described embodiment, although an application to an ink jet recording apparatus for graphic printing has been described as an example, the applicable range of the present invention is not limited to this example. Thus, the present invention can be widely applied to an ink jet system that draws various shapes or patterns by using a liquid-phase functional material such as a wiring drawing apparatus that draws a wiring pattern of an electronic circuit, a manufacturing apparatus of various devices, a resist printing apparatus using resin liquid as functional liquid for discharge, a color filter manufacturing apparatus, and a microscopic structure forming apparatus that forms microscopic structures by using a material for material deposition.

As above, while the ink jet recording apparatus and the image forming method according to the present invention have been described in detail, an appropriate change can be made therein in the range not departing from the concept of the present invention.

Note

As perceived from the description of the embodiment presented in detail as above, in the present specification includes disclosure of various technical ideas including the inventions represented below.

(Invention 1) There is provided a driving device for a liquid discharging head that discharges a liquid droplet from a nozzle by supplying a driving signal to a discharge energy generating element, the driving device including: a driving signal generating unit that generates the driving signal used for operating the discharge energy generating element that is disposed in correspondence with the nozzle of the liquid discharging head. The driving signal includes a plurality of discharge pulses used for performing discharging a plurality of times in one recording period, a final pulse of the plurality of discharge pulses is configured such that a wave height change time of a dead-end side wave height changing portion of the final pulse is equal to or longer than a quarter of a resonant period Tc, and at least one of the plurality of discharge pulses is configured such that a pulse width represented by a time from a starting end of the pulse to a starting end of the dead-end side wave height changing portion is a half of the resonant period Tc.

According to Invention 1, in a case where discharging is performed a plurality of times in one recording period, and recording of one pixel (one dot) is performed by using a plurality of liquid droplets, by configuring a wave height change time of the dead-end side wave height changing portion of the final pulse of a plurality of discharge pulses to be equal to or longer than a quarter of a resonant period Tc and configuring the pulse width of at least one of the plurality of discharge pulses to be a half of the resonant period Tc, the generation of a satellite liquid droplet can be prevented without changing the amount of the discharged liquid droplet and the speed of the discharged liquid droplet.

Here, the "dead-end side wave height changing portion" represents a portion in which the dead-end side wave height changes in a pulse signal having a trapezoidal shape. In addition, the "wave height change time of the dead-end side wave height changing portion" represents a time required for the wave height of the wave height changing portion to change from the maximum value to the minimum value.

It is preferable to configure the pulse width of the leading pulse out of the plurality of discharge pulses to a half of the resonant period Tc, and it is more preferable to configure the pulse widths of all the plurality of discharge pulses to be a half of the resonant period Tc.

In a form in which the "dead-end side wave height changing portion" is set as a rise of the wave height, the "wave height change time of the dead-end side wave height changing portion" is a rising time of the waveform. On the other hand, in a form in which the "dead-end side wave height changing portion" is set as a fall of the wave height, the "wave height change time of the dead-end side wave height changing portion" is a falling time of the waveform.

(Invention 2) In the driving device for a liquid discharging head described in Invention 1, it is preferable that, in the driving signal, at least one of pulse intervals of the plurality of discharge pulses is an integral multiple of the resonant period Tc.

According to such an aspect, by using the resonant period Tc, consecutive discharges using a plurality of discharge pulses can be efficiently performed.

Among the plurality of discharge pulses, it is preferable to configure the pulse interval between the leading pulse and the next pulse to be a positive integral multiple of the resonant period Tc, and it is more preferable to configure the pulse interval of all the pulses of the plurality of discharge pulses to be a positive integral multiple of the resonant period Tc.

(Invention 3) In the driving device for a liquid discharging head described in Invention 1 or 2, it is preferable that, within a remaining pulse train acquired by excluding the final pulse from the plurality of pulses, it is preferable that a voltage amplitude of a successive pulse is smaller than that of a preceding pulse, and a voltage amplitude of the final pulse is the largest among the plurality of discharge pulses.

According to such an aspect, a preceding liquid droplet can be integrated with the final liquid droplet discharged in accordance with the final pulse, and accordingly, a target droplet amount and a target droplet speed are achieved while a satisfactory discharge state is realized. In addition, a voltage level that is necessary for the droplet amount can be lowered.

(Invention 4) In the driving device for a liquid discharging head described in any one of Inventions 1 to 3, it is preferable that, in the driving signal, a wave height change time of a dead-end side wave height changing portion is less than that of a dead-end side wave height changing portion of the final pulse within a remaining pulse train acquired by excluding the final pulse from the plurality of discharge pulses.

According to such an aspect, (wave height changing time of the dead-end side wave height changing portion of the final pulse)>(wave height changing time of the dead-end side wave height changing portion of a pulse other than the final pulse). Accordingly, in the case of continuous discharges using discharge pulses other than the final pulse, liquid droplet discharging can be performed with high efficiency using a resonance phenomenon.

In addition, it is also preferable to configure the wave height changing time of the dead-end side wave height changing portion to be the same.

(Invention 5) In the driving device for a liquid discharging head described in any one of Inventions 1 to 4, it is preferable that, within a remaining pulse train acquired by excluding the final pulse from the plurality of discharge pulses, a voltage amplitude of a successive pulse gradually decreases.

According to such an aspect, by gradually decreasing the voltage amplitude of the discharge pulse other than the final pulse, the discharge speed of the liquid droplet after the second discharge gradually decreases, and accordingly, integration through the final liquid droplet can be easily performed.

(Invention 6) In the driving device for a liquid discharging head described in any one of Inventions 1 to 5, it is preferable that the driving signal generating unit can generate a first driving signal as the driving signal in which N (here, N is an integer equal to or greater than three) discharge pulses are included in one recording period and a second driving signal in which M (here, M is an integer equal to or greater than one) discharge pulses are added to a former stage of the N discharge pulses that configure the first driving signal, and the added M discharge pulses are pulses having a voltage amplitude that is smaller than a voltage amplitude of a leading pulse in the N discharge pulses.

According to such an aspect, discharge with different droplet amounts can be performed, and it is possible to align the discharge speeds of droplet types.

(Invention 7) In the driving device for a liquid discharging head described in Invention 6, it is preferable that discharging with a different droplet amount can be performed by selecting K (here, K is an integer equal to or greater than one and equal to or less than M+N) discharge pulses from the rear side from the second driving signal in which M+N discharge pulses are included in one recording period and supplying the selected discharge pulses to the discharge energy generating element.

According to such an aspect, in the case of a configuration in which the waveform of the second driving signal includes the waveform (the waveform of the first driving signal or the like) of a droplet type having a less droplet amount, by selecting a discharge pulse from the rear side of the waveform, driving waveforms corresponding to a plurality of droplet types can be acquired.

(Invention 8) In the driving device for a liquid discharging head described in Invention 1 or 2, it is preferable that, in a remaining pulse train acquired by excluding the final pulse from the plurality of discharge pulses, when discharge speeds according to each pulse, which is acquired in a case where each pulse within the remaining pulse train is extracted alone and is used for single discharge, are compared with each other, the discharge speed according to a successive pulse is configured to be lower than that of a preceding pulse within the remaining pulse train, and the final pulse performs discharging at a discharge speed that is the highest of all the discharge pulses of the remaining pulse train that precedes the final pulse.

According to such an aspect, similarly to Invention 3, a preceding liquid droplet can be integrated with the final liquid droplet discharged in accordance with the final pulse, and accordingly, a target droplet amount and a target droplet speed are achieved while a satisfactory discharge state is realized. In addition, a voltage level that is necessary for the droplet amount can be lowered.

(Invention 9) In the driving device for a liquid discharging head described in Invention 8, it is preferable that, within the remaining pulse train acquired by excluding the final pulse from the plurality of discharge pulses, the driving signal is configured such that the discharge speed according to a successive pulse is gradually lower.

According to such an aspect, in a second discharge operation and after that, the oscillation of the meniscus according to the preceding pulse can be used, the output according to the successive pulse can be weakened, and a preceding liquid droplet can be easily integrated with the final pulse, whereby a satisfactory discharge state is realized.

(Invention 10) In the driving device for a liquid discharging head described in any one of Inventions 1 to 9, it is preferable that a preceding liquid droplet discharged in accordance with application of a discharge pulse that precedes the final pulse and a final liquid droplet discharged in accordance with the final pulse are integrated together during flight.

In such an aspect, it is preferable that, the arrangement of the discharge pulses is determined such that a main liquid droplet lands after the main liquid droplet is formed by integrating a plurality of liquid droplets during flight which are consecutively discharged in one recording period (Invention 11) In the driving device for a liquid discharging head described in any one of Inventions 1 to 10, it is preferable that the driving signal is configured such that a pulse interval of a successive pulse is gradually shifted from the resonant period Tc within a remaining pulse train acquired by excluding the final pulse from the plurality of discharge pulses.

According to such an aspect, the waveform is adjusted by combining the voltage amplitude and the pulse interval of the discharge pulse, and accordingly, a target droplet amount and a target droplet speed can be easily realized.

(Invention 12) In the driving device for a liquid discharging head described in any one of Inventions 1 to 11, it is preferable that the driving signal is configured such that a pulse width of a successive pulse is gradually shifted from a half of the resonant period Tc within a remaining pulse train acquired by excluding the final pulse from the plurality of discharge pulses.

According to such an aspect, the waveform is adjusted by combining the voltage amplitude and the pulse interval of the discharge pulse, and accordingly, a target droplet amount and a target droplet speed can be easily realized.

(Invention 13) In the driving device for a liquid discharging head described in any one of Inventions 1 to 12, it is preferable that the driving signal is configured such that the inclination of a wave height changing portion of a successive pulse is gradually decreased within a remaining pulse train acquired by excluding the final pulse from the plurality of discharge pulses.

According to such an aspect, the waveform is adjusted by combining the voltage amplitude of the discharge pulse and the inclination of the wave height changing portion of the pulse, and accordingly, a target droplet amount and a target droplet speed can be easily realized.

(Invention 14) In the driving device for a liquid discharging head described in any one of Inventions 1 to 13, it is preferable that, in the driving signal, a reverberation suppressing pulse is included in a later stage of the final pulse of the plurality of discharge pulses.

According to such an aspect, by combining the reverberation suppressing pulse, the outlet ratio of the final pulse can be further improved, and the meniscus oscillation (reverberation) after discharge for one recording period is decreased, whereby the consecutive discharging operations can be stabilized.

(Invention 15) In the driving device for a liquid discharging head described in any one of Inventions 1 to 14, it is preferable that a waveform data storing unit that stores digital waveform data representing a waveform of the driving signal, a D/A converter that converts the digital waveform data read out from the waveform data storing unit into an analog signal, and a switching unit that controls timing at which the driving signal generated through the D/A converter is applied to the discharge energy generating element are further included.

(Invention 16) There is provided a liquid discharging apparatus including: a liquid discharging head that includes a nozzle used for discharging a liquid droplet, a pressure chamber that communicates with the nozzle, and a discharge energy generating element that is disposed in the pressure chamber; and the driving device for a liquid discharging head described in any one of Inventions 1 to 15 as a driving device for discharging a liquid droplet from the nozzle of the liquid discharging head.

(Invention 17) There is provided an ink jet recording apparatus including: an ink jet head as the liquid discharging head that includes a nozzle used for discharging a liquid droplet, a pressure chamber that communicates with the nozzle, and a discharge energy generating element that is disposed in the pressure chamber; and the driving device for a liquid discharging head described in any one of Inventions 1 to 15 as a driving device for discharging a liquid droplet from the nozzle of the liquid discharging head.

What is claimed is:

1. A driving device for a liquid discharging head that discharges a liquid droplet from a nozzle by supplying a driving signal to a discharge energy generating element, the driving device comprising:

a driving signal generating unit that generates the driving signal used for operating the discharge energy generating element that is disposed in correspondence with the nozzle of the liquid discharging head, wherein the driving signal includes a plurality of discharge pulses used for performing discharging a plurality of times in one recording period, wherein a final pulse of the plurality of discharge pulses is configured such that a wave height change time of a dead-end side wave height changing portion of the final pulse is equal to or longer than a quarter of a resonant period Tc, and wherein at least one of the plurality of discharge pulses is configured such that a pulse width represented by a time from a starting end of the pulse to a starting end of the dead-end side wave height changing portion is a half of the resonant period Tc.

2. The driving device for a liquid discharging head according to claim 1, wherein, in the driving signal, at least one of pulse intervals of the plurality of discharge pulses is an integral multiple of the resonant period Tc.

3. The driving device for a liquid discharging head according to claim 2, wherein, within a remaining pulse train acquired by excluding the final pulse from the plurality of discharge pulses, a voltage amplitude of a successive pulse is smaller than that of a preceding pulse, and a voltage amplitude of the final pulse is the largest among the plurality of discharge pulses.

4. The driving device for a liquid discharging head according to claim 2, wherein, in the driving signal, a wave height change time of a dead-end side wave height changing portion is less than that of a dead-end side wave height changing portion of the final pulse within a remaining pulse train acquired by excluding the final pulse from the plurality of discharge pulses.

5. The driving device for a liquid discharging head according to claim 2, wherein, in a remaining pulse train acquired by excluding the final pulse from the plurality of discharge pulses, when discharge speeds according to each pulse, which is acquired in a case where each pulse within the remaining pulse train is extracted alone and is used for single discharge, are compared with each other, the discharge speed according to a successive pulse is configured to be lower than that of a preceding pulse within the remaining pulse train, and wherein the final pulse performs discharging at a discharge speed that is the highest of all the discharge pulses of the remaining pulse train that precedes the final pulse.

6. The driving device for a liquid discharging head according to claim 1, wherein, within a remaining pulse train acquired by excluding the final pulse from the plurality of discharge pulses, a voltage amplitude of a successive pulse is smaller than that of a preceding pulse, and a voltage amplitude of the final pulse is the largest among the plurality of discharge pulses.

7. The driving device for a liquid discharging head according to claim 1, wherein, in the driving signal, a wave height change time of a dead-end side wave height changing portion is less than that of a dead-end side wave height changing portion of the final pulse within a remaining pulse train acquired by excluding the final pulse from the plurality of discharge pulses.

8. The driving device for a liquid discharging head according to claim 1, wherein, within a remaining pulse train acquired by excluding the final pulse from the plurality of discharge pulses, a voltage amplitude of a successive pulse gradually decreases.

9. The driving device for a liquid discharging head according to claim 1, wherein the driving signal generating unit can generate a first driving signal as the driving signal in which N (here, N is an integer equal to or greater than three) discharge pulses are included in one recording period and a second driving signal in which M (here, M is an integer equal to or greater than one) discharge pulses are added to a former stage of the N discharge pulses that configure the first driving signal, and the added M discharge pulses are pulses having a voltage amplitude that is smaller than a voltage amplitude of a leading pulse in the N discharge pulses.

10. The driving device for a liquid discharging head according to claim 9, wherein discharging with a different droplet amount can be performed by selecting K (here, K is an integer equal to or greater than one and equal to or less than M+N) discharge pulses from the rear side from the second driving signal in which M+N discharge pulses are included in one recording period and supplying the selected discharge pulses to the discharge energy generating element.

11. The driving device for a liquid discharging head according to claim 1, wherein, in a remaining pulse train acquired by excluding the final pulse from the plurality of discharge pulses, when discharge speeds according to each pulse, which is acquired in a case where each pulse within the remaining pulse train is extracted alone and is used for single discharge, are compared with each other, the discharge speed according to a successive pulse is configured to be lower than that of a preceding pulse within the remaining pulse train, and wherein the final pulse performs discharging at a discharge speed that is the highest of all the discharge pulses of the remaining pulse train that precedes the final pulse.

12. The driving device for a liquid discharging head according to claim 11, wherein, within the remaining pulse train acquired by excluding the final pulse from the plurality of discharge pulses, the driving signal is configured such that the discharge speed according to a successive pulse is gradually lower.

13. The driving device for a liquid discharging head according to claim 1, wherein a preceding liquid droplet discharged in accordance with application of a discharge pulse that precedes the final pulse and a final liquid droplet discharged in accordance with the final pulse are integrated together during flight.

14. The driving device for a liquid discharging head according to claim 1, wherein the driving signal is configured such that a pulse interval of a successive pulse is gradually shifted from the resonant period Tc within a remaining pulse train acquired by excluding the final pulse from the plurality of discharge pulses.

15. The driving device for a liquid discharging head according to claim 1, wherein the driving signal is configured such that a pulse width of a successive pulse is gradually shifted from a half of the resonant period Tc within a remaining pulse train acquired by excluding the final pulse from the plurality of discharge pulses.

16. The driving device for a liquid discharging head according to claim 1, wherein the driving signal is configured such that the inclination of a wave height changing portion of a successive pulse is gradually decreased within a remaining pulse train acquired by excluding the final pulse from the plurality of discharge pulses.

17. The driving device for a liquid discharging head according to claim 1, wherein, in the driving signal, a reverberation suppressing pulse is included in a later stage of the final pulse of the plurality of discharge pulses.

18. The driving device for a liquid discharging head according to claim 1, further comprising:

a waveform data storing unit that stores digital waveform data representing a waveform of the driving signal;

a D/A converter that converts the digital waveform data read out from the waveform data storing unit into an analog signal; and a switching unit that controls timing at which the driving signal generated through the D/A converter is applied to the discharge energy generating element.

19. A liquid discharging apparatus comprising:

a liquid discharging head that includes a nozzle used for discharging a liquid droplet, a pressure chamber that communicates with the nozzle, and a discharge energy generating element that is disposed in the pressure chamber; and the driving device for a liquid discharging head according to claim 1 as a driving device for discharging a liquid droplet from the nozzle of the liquid discharging head.

20. An ink jet recording apparatus comprising:

an ink jet head as the liquid discharging head that includes a nozzle used for discharging a liquid droplet, a pressure chamber that communicates with the nozzle, and a discharge energy generating element that is disposed in the pressure chamber; and the driving device for a liquid discharging head according to claim 1 as a driving device for discharging a liquid droplet from the nozzle of the liquid discharging head.

* * * * *